US010131153B2

(12) United States Patent
Sato et al.

(10) Patent No.: US 10,131,153 B2
(45) Date of Patent: Nov. 20, 2018

(54) IMAGE-RECORDING APPARATUS INCLUDING ATTACHMENT PORTION HAVING LIQUID CHAMBER CONNECTABLE TO LIQUID CARTRIDGE

(71) Applicant: BROTHER KOGYO KABUSHIKI KAISHA, Nagoya-shi, Aichi-ken (JP)

(72) Inventors: Masatake Sato, Nagoya (JP); Akinari Ishibe, Okazaki (JP); Yuma Tanabe, Nagoya (JP); Masahiro Hayashi, Nagoya (JP); Akihito Kobayashi, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,728

(22) Filed: Sep. 29, 2017

(65) Prior Publication Data

US 2018/0178536 A1 Jun. 28, 2018

(30) Foreign Application Priority Data

Dec. 28, 2016 (JP) ..... 2016-256358

(51) Int. Cl.
*B41J 2/175* (2006.01)

(52) U.S. Cl.
CPC ..... *B41J 2/17566* (2013.01); *B41J 2/17523* (2013.01)

(58) Field of Classification Search
CPC ..... B41J 2/17566; B41J 2/17523
See application file for complete search history.

(56) References Cited

U.S. PATENT DOCUMENTS

2009/0201351 A1 8/2009 Shimizu et al.
2013/0321501 A1* 12/2013 Igarashi ..... B41J 2/175 347/7

FOREIGN PATENT DOCUMENTS

JP 2008-238792 A 10/2008

* cited by examiner

*Primary Examiner* — Julian Huffman
(74) *Attorney, Agent, or Firm* — Merchant & Gould P.C.

(57) ABSTRACT

An image-recording apparatus includes a cartridge including a first storage chamber and a first air communication portion, a cartridge-attachment portion including a second storage chamber and a second air communication portion, a switching portion, and a controller. The second storage chamber stores liquid supplied from a supply portion of the cartridge connected to a connecting portion of the cartridge-attachment portion through a liquid outlet port. The switching portion switches the second air communication portion between a first state and a second state. An air flow rate through the second air communication portion per unit of time is lower in the second state than in the first state. The controller determines the liquid level of liquid in the first storage chamber and switches the switching portion to the second state when the liquid level in the first storage chamber is lower than a vertical position of the liquid outlet port.

8 Claims, 13 Drawing Sheets

IMAGE-RECORDING APPARATUS INCLUDING ATTACHMENT PORTION HAVING LIQUID CHAMBER CONNECTABLE TO LIQUID CARTRIDGE

CROSS REFERENCE TO RELATED APPLICATION

This application claims priority from Japanese Patent Application No. 2016-256358 filed on Dec. 28, 2016. The entire content of the priority application is incorporated herein by reference.

TECHNICAL FIELD

The present disclosure relates to an image-recording apparatus including a cartridge having a first storage chamber and a cartridge-attachment portion having a second storage chamber.

BACKGROUND

Japanese Patent Application Publication No. 2008-238792 discloses a liquid-ejection device including a main body and a cartridge. The main body includes a liquid-ejection head and a sub-tank. The cartridge has a liquid storage chamber and is detachably attachable to the main body.

Ink in the liquid storage chamber flows into the sub-tank in accordance with outflow of the ink from the sub-tank to the liquid-ejection head. Both of the sub-tank and the liquid storage chamber are in communication with an atmosphere. Therefore, a liquid level of ink in the sub-tank eventually becomes equal to a liquid level of ink in the liquid storage chamber.

SUMMARY

However, due to the communication of the sub-tank and the liquid storage chamber with the atmosphere, ink evaporation may occur in the sub-tank and the liquid storage chamber. Thus, an amount of usable ink may be decreased. Further, in case that a residual amount of ink is configured to be determined by way of dot count system under a software, detection accuracy of the residual amount of ink may become lower due to the evaporation of ink.

In view of the foregoing, it is an object of the disclosure to provide an image-recording apparatus including a cartridge having a first storage chamber and a cartridge-attachment portion having a second storage chamber, the apparatus being capable of restraining evaporation of liquid stored in the second storage chamber.

In order to attain the above and other objects, according to one aspect, the disclosure provides an image-recording apparatus including a cartridge, a cartridge-attachment portion, a switching portion, a recording portion and a controller. The cartridge includes a first storage chamber configured to store liquid, a first air communication portion configured to allow the first storage chamber to communicate with an atmosphere, and a supply portion configured to supply the liquid stored in the first storage chamber. The cartridge-attachment portion includes: a connecting portion configured to be connected to the supply portion; a liquid inlet port in communication with the connecting portion; a second storage chamber in communication with the connecting portion through the liquid inlet port and configured to store the liquid supplied from the connecting portion connected to the supply portion through the liquid inlet port; a liquid outlet port positioned lower than the liquid inlet port in a vertical direction and configured to discharge the liquid from the second storage chamber; and a second air communication portion configured to allow the second storage chamber to communicate with the atmosphere. The switching portion is configured to switch a state of the second air communication portion between a first state and a second state, air being allowed to flow through the second air communication portion in the first state, and an amount of air that flows through the second air communication portion per unit of time being smaller in the second state than in the first state. The recording portion includes a nozzle through which the liquid supplied from the second storage chamber through the liquid outlet port is configured to be ejected. The controller is configured to determine a liquid level of the liquid stored in the first storage chamber in the vertical direction, the controller being further configured to control the switching portion to switch the second air communication portion to the second state from the first state in case that the liquid level of the liquid stored in the first storage chamber is determined to be equal to or lower than a position of the liquid inlet port in the vertical direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
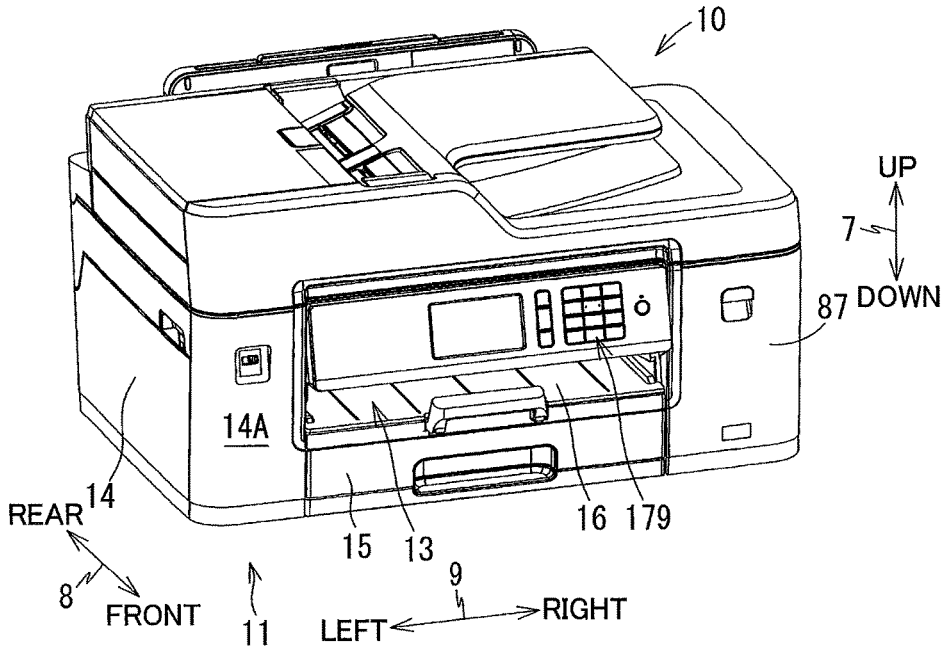
FIG. 1A is a perspective view of a multifunction peripheral according to an embodiment, illustrating a closed position of a cover of the multifunction peripheral.

A multifunction peripheral 10 as an example of an image-recording apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be used assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface of the multifunction peripheral 10 in the operable posture. A left-right direction 9 is defined based on an assumption that the multifunction peripheral 10 in the operable posture is viewed from its front surface. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

[Overall Structure of Multifunction Peripheral 10]

Figure 1B:
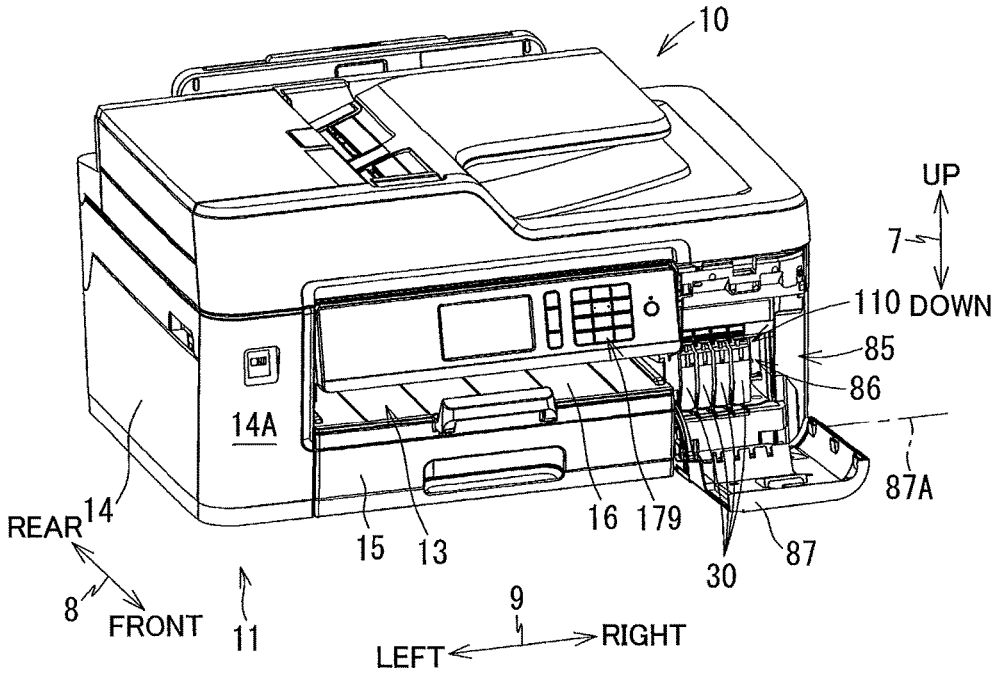
FIG. 1B is a perspective view of the multifunction peripheral according to the embodiment, illustrating an open position of the cover.

As illustrated in FIGS. 1A and 1B, the multifunction peripheral 10 has a substantially rectangular parallelepiped shape. The multifunction peripheral 10 has a lower portion in which a printer portion 11 is provided. The printer portion 11 includes a casing 14 whose front surface 14A is formed with the opening 13. The printer portion 11 is configured to record an image on a sheet of paper 12 (see FIG. 2) based on an inkjet recording method.

Figure 2:
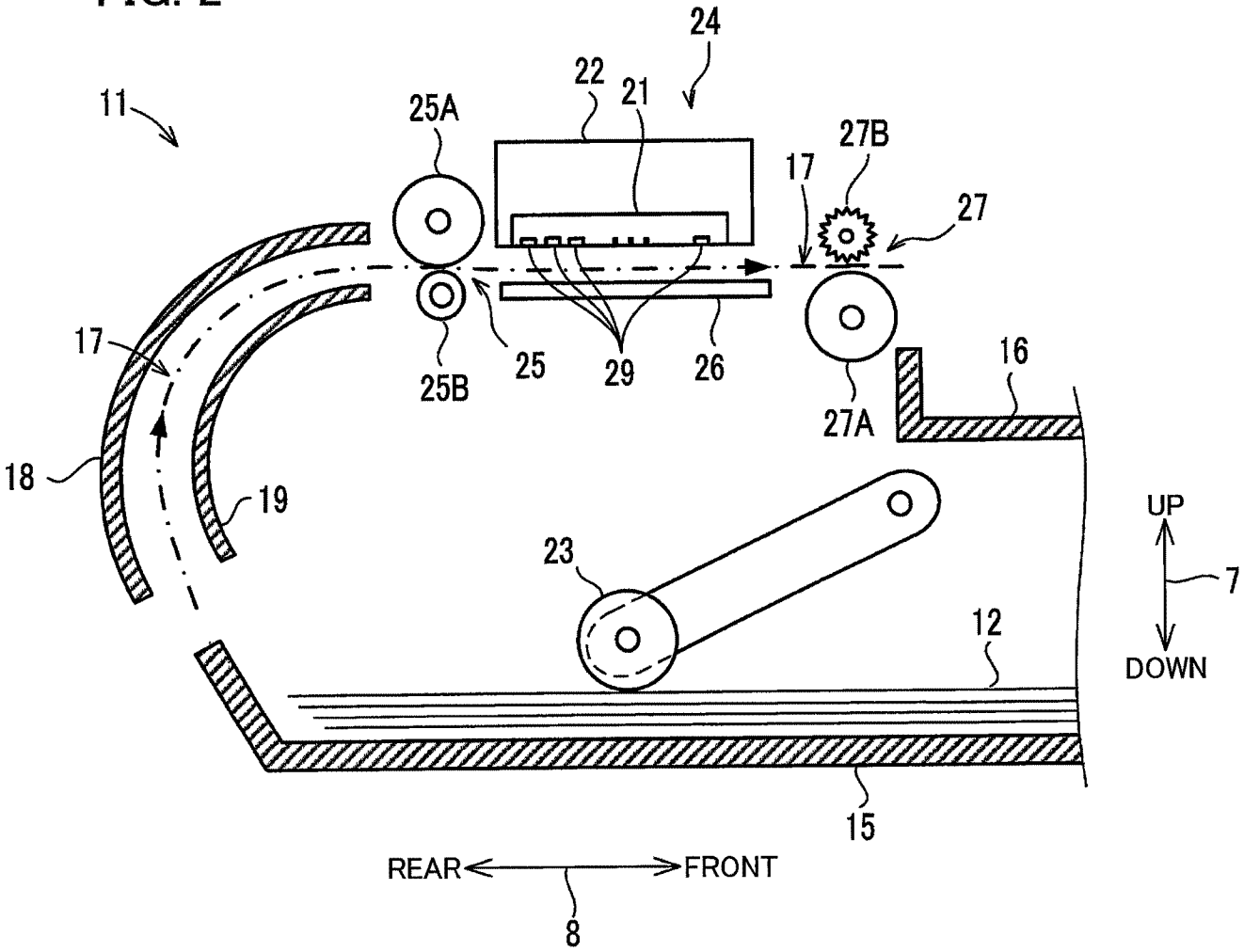
FIG. 2 is a vertical cross-sectional view schematically illustrating an internal configuration of a printer portion of the multifunction peripheral according to the embodiment.

As illustrated in FIG. 2, within the casing 14, a feeding roller 23, a feeding tray 15, a discharge tray 16, a pair of conveying rollers 25, a recording portion 24, a pair of discharging rollers 27, a platen 26, and a cartridge-attachment portion 110 (see FIG. 1B) are disposed.

The multifunction peripheral 10 has various functions such as a facsimile function and a printing function. As described above, the posture of the multifunction peripheral 10 illustrated in FIG. 1A is the operable posture of the multifunction peripheral 10.

<Feeding Tray 15, Discharge Tray 16, and Feeding Roller 23>

As illustrated in FIGS. 1A and 1B, the feeding tray 15 is configured to be inserted into and extracted from the casing 14 through the opening 13 in the front-rear direction 8 by a user. The opening 13 is positioned at a center portion of the front surface 14A of the casing 14 in the left-right direction 9. As illustrated in FIG. 2, the feeding tray 15 is configured to support the sheets 12 in a stacked state.

The discharge tray 16 is disposed above the feeding tray 15. The discharge tray 16 is configured to support the sheets 12 discharged by the discharging rollers 27 from a position between the recording portion 24 and the platen 26.

The feeding roller 23 is configured to feed the sheets 12 supported in the feeding tray 15 onto a conveying path 17. The feeding roller 23 is configured to be driven by a feeding motor 172 (see FIG. 8).

<Conveying Path 17>

As illustrated in FIG. 2, the conveying path 17 is a space partially defined by an outer guide member 18 and an inner guide member 19 opposing each other at a predetermined interval inside the printer portion 11. The conveying path 17 extends rearward from a rear end portion of the feeding tray 15, and then, makes a U-turn frontward while extending upward at a rear portion of the printer portion 11, passes through a space between the recording portion 24 and the platen 26, and reaches the discharge tray 16. A portion of the conveying path 17 positioned between the conveying rollers 25 and the discharging rollers 27 is provided substantially at a center portion of the multifunction peripheral 10 in the left-right direction 9, and extends in the front-rear direction 8. A conveying direction of each sheet 12 in the conveying path 17 is indicated by a dashed-dotted arrow in FIG. 2.

<Conveying Rollers 25>

As illustrated in FIG. 2, the pair of conveying rollers 25 is disposed at the conveying path 17. The conveying rollers 25 include a conveying roller 25A and a pinch roller 25B arranged to oppose each other. The conveying roller 25A is configured to be driven by a conveying motor 171 (see FIG. 8). The pinch roller 25B is rotated following rotation of the conveying roller 25A. As the conveying roller 25A makes forward rotation in response to forward rotation of the conveying motor 171, each of the sheets 12 is nipped between the conveying roller 25A and the pinch roller 25B, thereby being conveyed in the conveying direction (i.e., frontward direction).

<Discharging Rollers 27>

As illustrated in FIG. 2, the pair of discharging rollers 27 is disposed downstream relative to the pair of conveying rollers 25 in the conveying direction at the conveying path 17. The discharging rollers 27 include a discharging roller 27A and a spur 27B arranged to oppose each other. The discharging roller 27A is configured to be driven by the conveying motor 171 (see FIG. 8). The spur 27B is configured to rotate following rotation of the discharging roller 27A. As the discharging roller 27A makes forward rotation in response to the forward rotation of the conveying motor 171, each sheet 12 is nipped between the discharging roller 27A and the spur 27B, thereby being conveyed in the conveying direction (i.e., frontward direction).

<Recording Portion 24>

As illustrated in FIG. 2, the recording portion 24 is disposed between the conveying rollers 25 and the discharging rollers 27 at the conveying path 17. The recording portion 24 is arranged to oppose the platen 26 in the up-down direction 7, with the conveying path 17 interposed between the recording portion 24 and the platen 26. The recording portion 24 includes a carriage 22 and a recording head 21.

Figure 3:
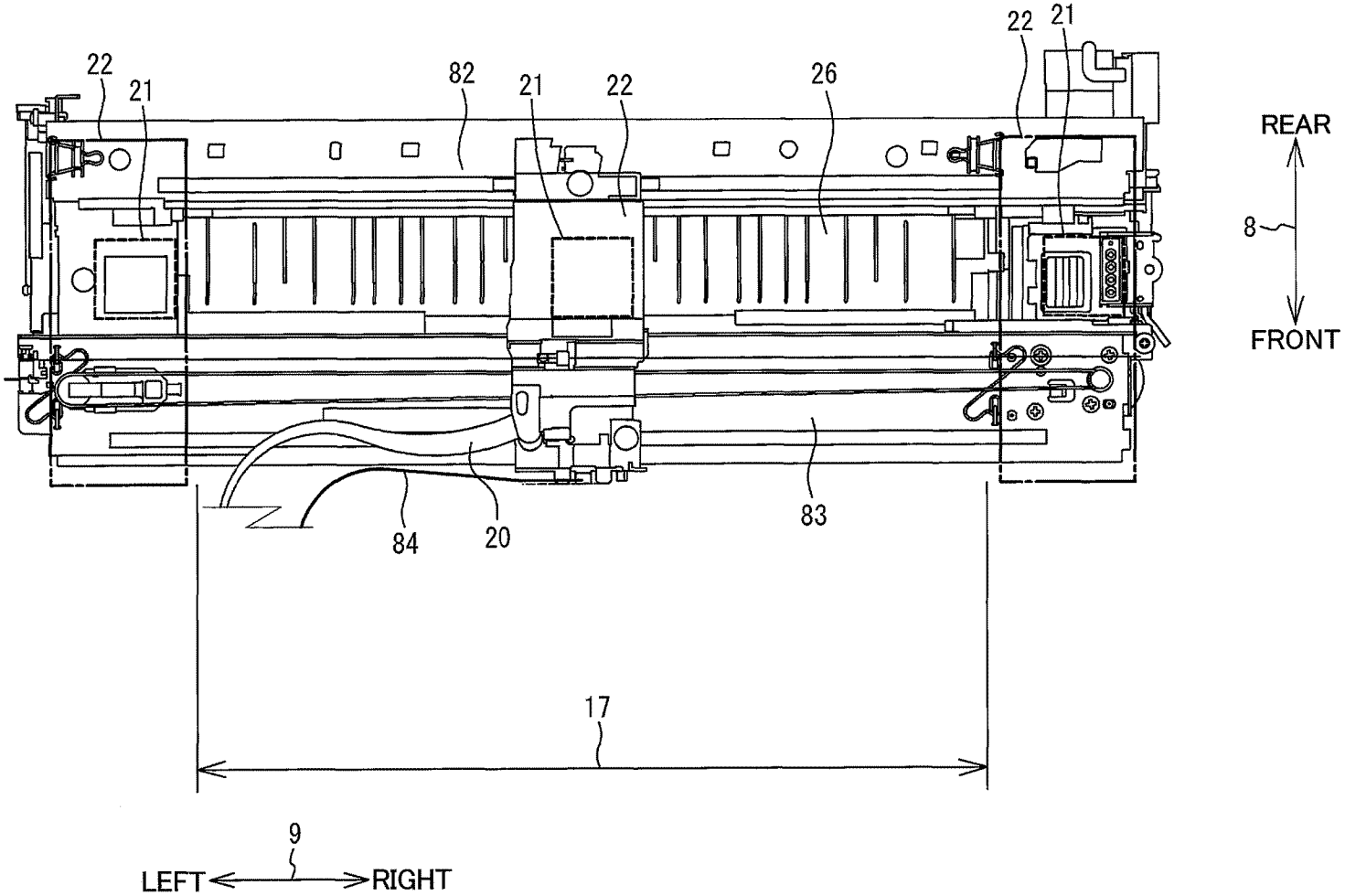
FIG. 3 is a plan view illustrating a positional relationship between a carriage and a platen of the multifunction peripheral according to the embodiment.

As illustrated in FIG. 3, the carriage 22 is supported by guide rails 82 and 83. The guide rails 82 and 83 extend in the left-right direction 9 to be spaced apart from each other in the front-rear direction 8. The guide rails 82 and 83 are supported by a frame (not shown) of the printer portion 11. The carriage 22 is connected to a well-known belt mechanism provided at the guide rail 83. The belt mechanism is driven by a carriage-driving motor 173 (see FIG. 8). The carriage 22 connected to the belt mechanism is configured to make reciprocating movements in the left-right direction 9 in response to driving by the carriage-driving motor 173. The carriage 22 is configured to move within a range from a right side relative to a right end of the conveyance path 17 to a left side relative to a left end of the conveyance path 17, as indicated by alternate long and short dash lines in FIG. 3.

As illustrated in FIG. 3, a bundle of ink tubes 20 and a flexible flat cable 84 extend from the carriage 22.

The ink tubes 20 connect the cartridge-attachment portion 110 (see FIG. 1B) to the recording head 21. Each of the ink tubes 20 is configured to supply ink stored in a corresponding ink cartridge 30 attached to the cartridge-attachment portion 110 to the recording head 21. Specifically, four ink tubes 20 are provided in one-to-one correspondence with four ink cartridges 30 so that ink of respective four colors (black, magenta, cyan, and yellow) can flow through the corresponding ink tubes 20. These four ink tubes 20 are bundled and connected to the carriage 22.

The flexible flat cable 84 is configured to establish electrical connection between a controller 130 (see FIG. 8) and the recording head 21. The flexible flat cable 84 is configured to transmit control signals outputted from the controller 130 to the recording head 21.

As illustrated in FIG. 2, the recording head 21 is mounted on the carriage 22. The recording head 21 includes a plurality of nozzles 29 and a piezoelectric element 45 (see FIG. 8). The nozzles 29 are arranged at a lower surface of the recording head 21. Ink flow passages are formed in the recording head 21. The piezoelectric element 45 is configured to deform a portion of the ink flow passages to allow ink droplets to be ejected through the nozzles 29. As will be described later in detail, the piezoelectric element 45 is configured to operate upon receipt of electric power supplied by the controller 130.

The recording portion 24 is configured to be controlled by the controller 130. As the carriage 22 moves in the left-right direction 9, the recording head 21 ejects ink droplets through the nozzles 29 onto the sheet 12 supported by the platen 26. In this way, an image is recorded on each sheet 12 and the ink stored in each ink cartridge 30 is consumed.

<Platen 26>

As illustrated in FIG. 2, the platen 26 is disposed between the conveying rollers 25 and the discharging rollers 27 at the conveying path 17. The platen 26 is arranged to oppose the recording portion 24 in the up-down direction 7, with the conveying path 17 interposed between the platen 26 and the recording portion 24. The platen 26 supports the sheet 12 conveyed by the conveying rollers 25 from below.

<Cover 87>

As illustrated in FIG. 1B, an opening 85 is formed in the front surface 14A of the casing 14 at a right end portion thereof. Rearward of the opening 85, an accommodation space 86 is formed to accommodate the cartridge-attachment portion 110 therein. A cover 87 is assembled to the casing 14 so as to be capable of covering the opening 85. The cover 87 is pivotally movable about a pivot axis 87A (pivot center) extending in the left-right direction 9 between a closed position (a position illustrated in FIG. 1A) for closing the opening 85 and an open position (a position illustrated in FIG. 1B) for exposing the opening 85.

<Cartridge-Attachment Portion 110>

Figure 4:
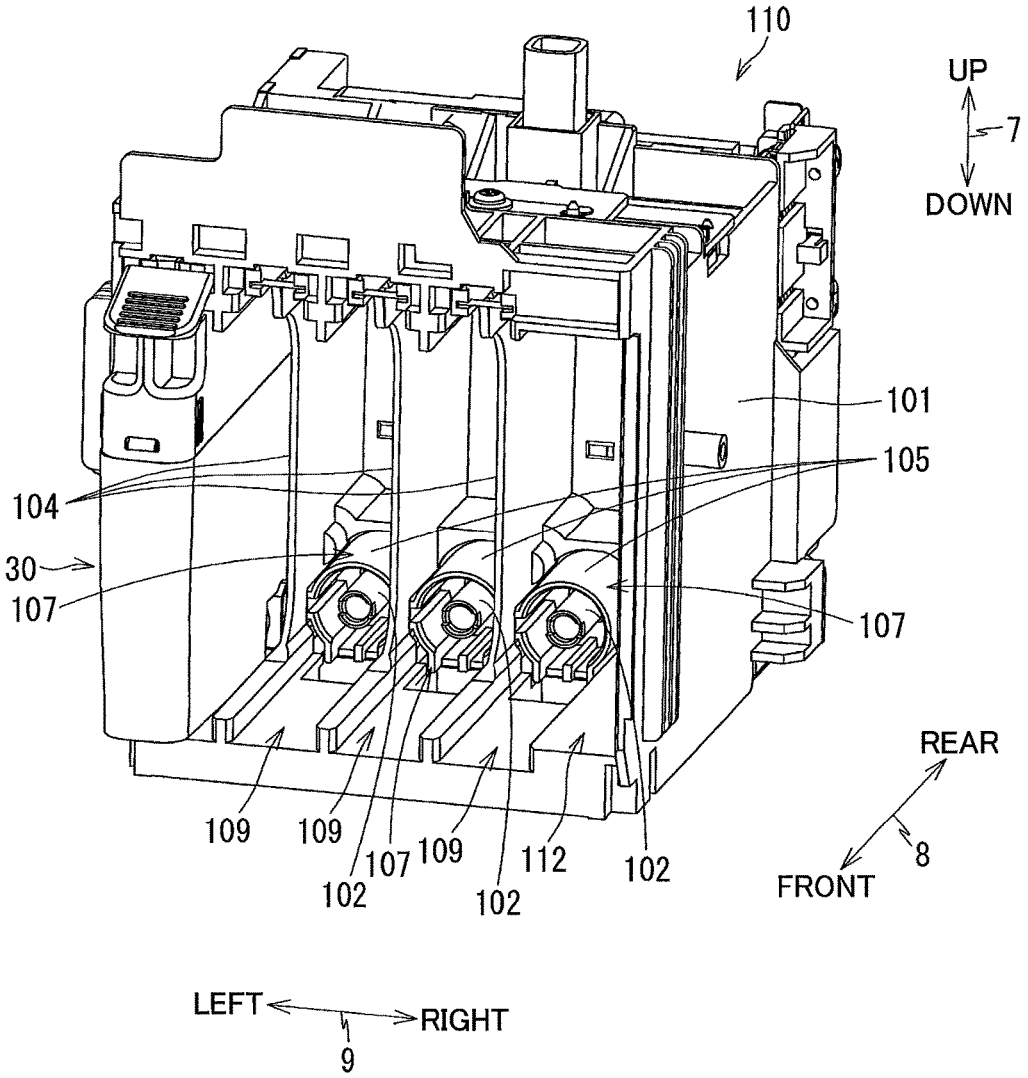
FIG. 4 is a perspective view of a cartridge-attachment portion provided in the multifunction peripheral according to the embodiment as viewed from a front side of the cartridge-attachment portion, and illustrating an opening formed in a front end of the cartridge-attachment portion.
Figure 5:
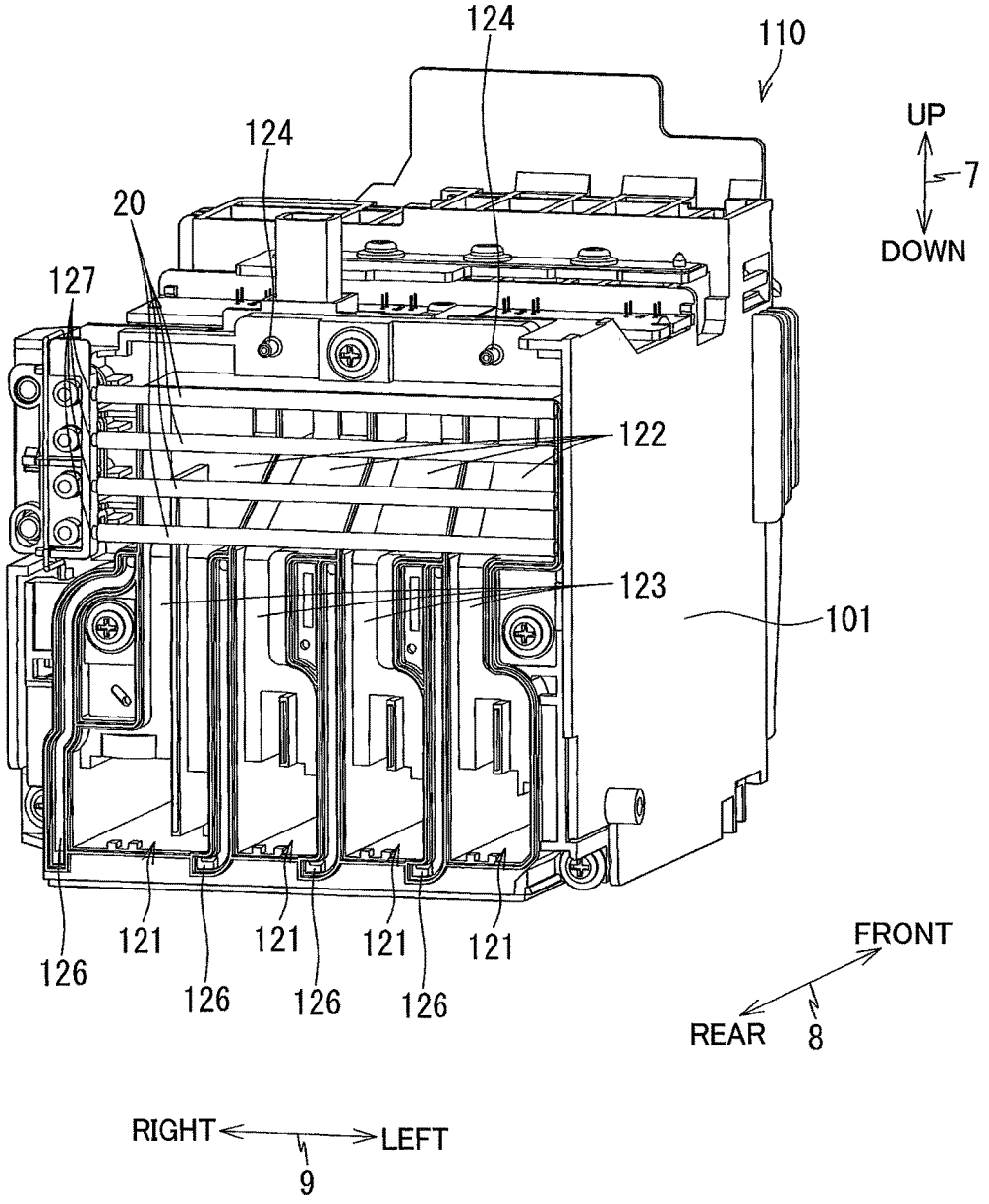
FIG. 5 is a perspective view of the cartridge-attachment portion according to the embodiment as viewed from a rear side thereof, and illustrating tanks provided at a rear end of the cartridge-attachment portion.
Figure 6:
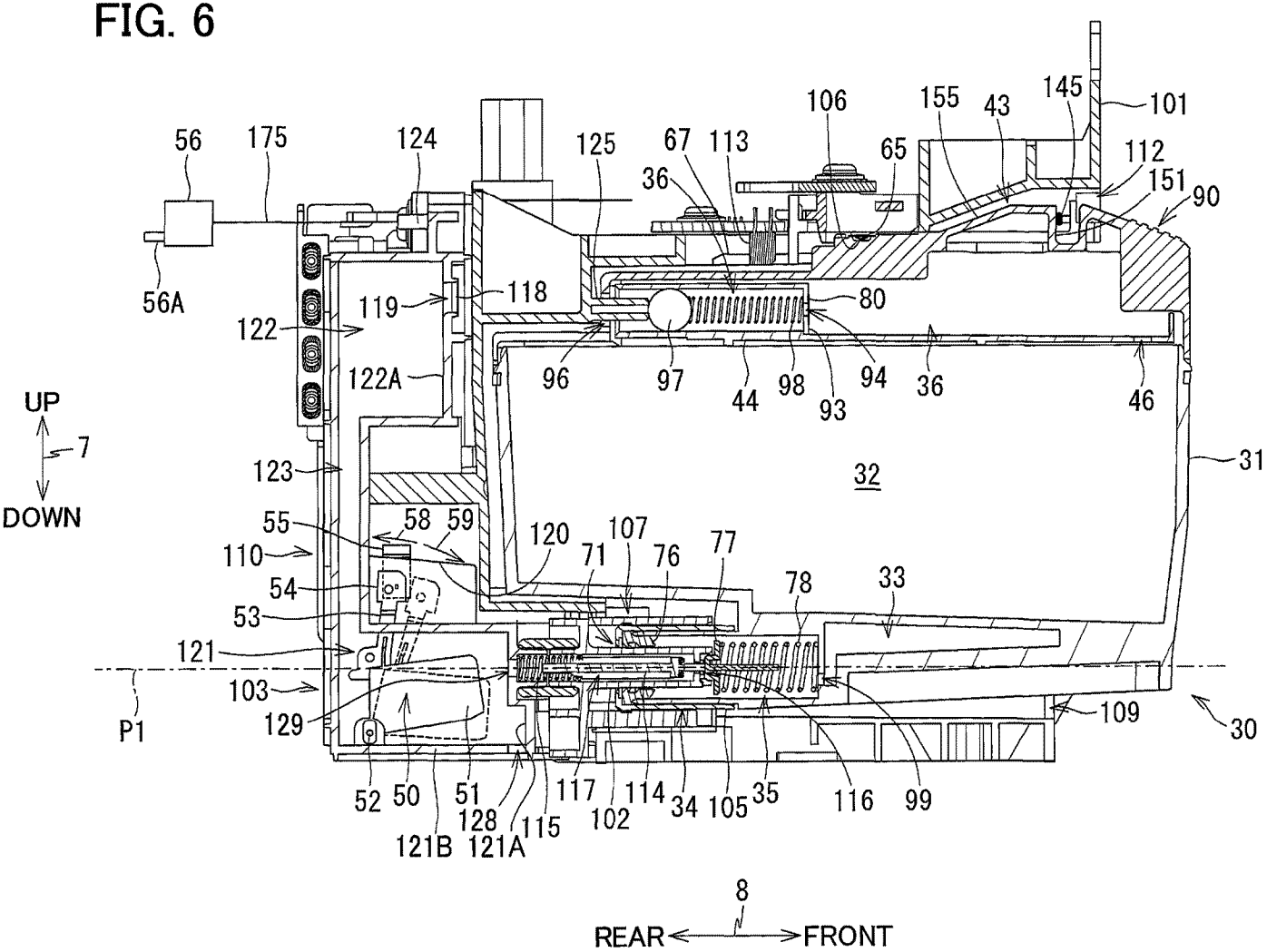
FIG. 6 is a vertical cross-sectional view of the cartridge-attachment portion according to the embodiment in a state where an ink cartridge is attached to the cartridge-attachment portion.

As illustrated in FIGS. 4 through 6, the cartridge-attachment portion 110 includes a case 101, connecting portions 107, contacts 106, rods 125, attachment sensors 113, a lock shaft 145, tanks 103, and liquid-level sensors 55. Four ink cartridges 30 corresponding to the four colors of ink (cyan, magenta, yellow, and black) are detachably attachable to the cartridge-attachment portion 110. One connecting portion 107, one set of four contacts 106, one rod 125, one attachment sensor 113, one tank 103, and one liquid-level sensor 55 are provided for each of the four ink cartridges 30. Thus, in the present embodiment, four connecting portions 107, four sets of the four contacts 106, four rods 125, four attachment sensors 113, four tanks 103, and four liquid-level sensors 55 are provided at the cartridge-attachment portion 110. Note that the number of the ink cartridges 30 that can be accommodated in the cartridge-attachment portion 110 is not limited to four, but may be any number.

<Case 101>

As illustrated in FIGS. 4 and 5, the case 101 constitutes a housing of the cartridge-attachment portion 110. The case 101 has a box-like shape defining an internal space therein. Specifically, the case 101 has an inner top surface defining a top of the internal space, an inner bottom surface defining a bottom of the internal space, an inner rear surface connecting the inner top surface and the inner bottom surface, and an opening 112 positioned opposite to the inner rear surface in the front-rear direction 8. The opening 112 can be exposed to the front surface 14A of the casing 14 serving as a user-interface surface of the multifunction peripheral 10 that a user can face when operating the multifunction peripheral 10.

The ink cartridges 30 can be inserted into and extracted from the case 101 through the opening 85 of the casing 14 and the opening 112 of the cartridge-attachment portion 110. In the case 101, the inner bottom surface is formed with four guide grooves 109 for guiding insertion and extraction of the respective ink cartridges 30 in the front-rear direction 8. Movements of the ink cartridges 30 in the front-rear direction 8 in FIG. 4 are guided by the corresponding guide grooves 109 as lower end portions of the ink cartridges 30 are inserted into the corresponding guide grooves 109. The case 101 is also provided with three plates 104 that partition the internal space of the case 101 into four individual spaces each elongated in the up-down direction 7. Each of the four spaces partitioned by the plates 104 is configured to receive one of the four ink cartridges 30.

In the following description and drawings, for simplifying explanation, only one ink cartridge 30 is assumed to be accommodated in the case 101 of the cartridge-attachment portion 110 unless specified otherwise.

<Connecting Portion 107>

As illustrated in FIG. 4, each connecting portion 107 includes an ink needle 102 and a guide portion 105.

The ink needle 102 is made of resin and has a generally tubular shape. The ink needle 102 is disposed at a lower end portion of the inner rear surface of the case 101. Specifically, the ink needle 102 is disposed on the inner rear surface of the case 101 at a position corresponding to an ink supply portion 34 (described later) of the ink cartridge 30 attached to the cartridge-attachment portion 110. The ink needle 102 protrudes frontward from the inner rear surface of the case 101.

The guide portion 105 has a cylindrical shape, and is disposed on the inner rear surface to surround the ink needle 102. The guide portion 105 protrudes frontward from the inner rear surface of the case 101. A protruding end (front end) of the guide portion 105 is open. Specifically, the ink needle 102 is positioned at a diametrical center of the guide portion 105. The guide portion 105 is so shaped that the ink supply portion 34 of the attached ink cartridge 30 is received in the guide portion 105.

In a state where the ink cartridge 30 is not attached to the cartridge-attachment portion 110, the connecting portion 107 is not connected to the ink supply portion 34 of the ink cartridge 30. During an insertion process of the ink cartridge 30 into the cartridge-attachment portion 110, i.e., in the course of action for bringing the ink cartridge 30 into an attached position in the cartridge-attachment portion 110 (i.e., a position illustrated in FIG. 6), the ink supply portion 34 of the ink cartridge 30 enters into the guide portion 105. As the ink cartridge 30 is inserted into the cartridge-attachment portion 110, the ink needle 102 enters into an ink supply port 71 formed in the ink supply portion 34. As a result, the connecting portion 107 is connected to the ink supply portion 34. Hence, ink stored in a storage chamber 33 formed in the ink cartridge 30 is allowed to flow into the tank 103 through an ink valve chamber 35 formed in the ink supply portion 34 and an internal space 117 (see FIG. 6) defined in the ink needle 102.

Incidentally, the ink needle 102 may have a flat-shaped tip end or a pointed tip end.

As illustrated in FIG. 6, a valve 114 and a coil spring 115 are accommodated in the internal space 117 of the ink needle 102. The valve 114 is movable in the front-rear direction 8 to open and close an opening 116 formed in a protruding tip end portion of the ink needle 102. That is, the valve 114 is configured to open and close the internal space 117 of the ink needle 102. The coil spring 115 urges the valve 114 frontward. Accordingly, the valve 114 closes off the opening 116 in a state where no external force is applied to the valve 114 (i.e., in a state where the ink cartridge 30 is not attached to the cartridge-attachment portion 110). Further, a front end portion of the valve 114 urged by the coil spring 115 protrudes frontward relative to the opening 116 in a state where no external force is applied to the valve 114. In the process of connecting the ink supply portion 34 to the connecting portion 107, the valve 114 opens the opening 116. Details on how the valve 114 opens the opening 116 will be described later.

<Contacts 106>

As illustrated in FIG. 6, each of the four sets of the four contacts 106 is provided on the inner top surface of the case 101. Each of the four contacts 106 in each set protrudes downward from the inner top surface toward the internal space of the case 101. Although not illustrated in detail in the drawings, in each set, the four contacts 106 are arranged spaced apart from one another in the left-right direction 9. Each of the four contacts 106 is arranged at a position corresponding to each one of four electrodes 65 (described later) of the ink cartridge 30. Each contact 106 is made of a material having electrical conductivity and resiliency. The contacts 106 are therefore upwardly resiliently deformable. The four sets of the four contacts 106 are provided each set for each one of the four ink cartridges 30 that can be accommodated in the case 101. Note that the number of the contacts 106 and the number of electrodes 65 may be arbitrary.

Each contact 106 is electrically connected to the controller 130 (see FIG. 8) via an electrical circuit. When the respective contacts 106 are engaged with the corresponding electrodes 65 and electrically connected thereto, a voltage Vc is applied to the corresponding electrode 65, the corresponding electrode 65 is grounded, and electric power is supplied to the corresponding electrode 65. Due to establishment of the electrical connection between the contacts 106 and the corresponding electrodes 65, the controller 130 can access data stored in an IC of the ink cartridge 30. Outputs from the contacts 106 through the electrical circuits are inputted into the controller 130.

<Rod 125>

As illustrated in FIG. 6, each of the rods 125 is provided at a position above the ink needle 102 on the inner rear surface of the case 101. The rod 125 protrudes frontward from the inner rear surface of the case 101. The rod 125 has a cylindrical shape. The rod 125 is configured to be inserted into an air communication port 96 (described later) in a state where the ink cartridge 30 is attached to the cartridge-attachment portion 110, that is, in a state where the ink cartridge 30 in in the attached position.

<Attachment Sensor 113>

As illustrated in FIG. 6, each of the attachment sensors 113 is also disposed at the inner top surface of the case 101. The attachment sensor 113 is configured to detect whether or not the ink cartridge 30 has been attached to the cartridge-attachment portion 110. The attachment sensor 113 is disposed at a position frontward of the rod 125 but rearward of the contacts 106. In the present embodiment, the attachment sensor 113 includes a light-emitting portion and a light-receiving portion. The light-emitting portion of the attachment sensor 113 is positioned rightward or leftward relative to the light-receiving portion of the attachment sensor 113. The light-emitting portion of the attachment sensor 113 is arranged opposite to and spaced apart from the light-receiving portion of the attachment sensor 113 in the left-right direction 9. When the ink cartridge 30 has been attached to the cartridge-attachment portion 110, a light-blocking plate 67 (described later) of the attached ink cartridge 30 is disposed between the light-emitting portion and the light-receiving portion of the attachment sensor 113. In other words, the light-emitting portion and the light-receiving portion of the attachment sensor 113 are arranged to oppose each other, with the light-blocking plate 67 of the attached ink cartridge 30 interposed therebetween.

The attachment sensor 113 is configured to output different detection signals depending on whether or not light emitted in the left-right direction 9 from the light-emitting portion of the attachment sensor 113 is received by the light-receiving portion of the attachment sensor 113. For example, the attachment sensor 113 is configured to output a low-level signal to the controller 130 (see FIG. 8) in case that the light-receiving portion of the attachment sensor 113 does not receive the light emitted from the light-emitting portion of the attachment sensor 113 (that is, when an intensity of the light received at the light-receiving portion is less than a predetermined intensity). On the other hand, the attachment sensor 130 is configured to output a high-level signal to the controller 130 (see FIG. 8) in case that the light emitted from the light-emitting portion of the attachment sensor 113 is received by the light-receiving portion of the attachment sensor 113 (that is, when the intensity of the received light is equal to or greater than the predetermined intensity).

<Lock Shaft 145>

As illustrated in FIG. 6, the lock shaft 145 extends in the left-right direction 9 at a position in the vicinity of the inner top surface of the case 101 and in the vicinity of the opening 112. The lock shaft 145 is a bar-like member extending in the left-right direction 9. The lock shaft 145 is, for example, a metal cylinder. The lock shaft 145 has a left end fixed to a left side wall of the case 101 defining a left end of the case 101, and a right end fixed to a right side wall of the case 101 defining a right end of the case 101. The lock shaft 145 extends in the left-right direction 9 over the four spaces in which the four ink cartridges 30 can be accommodated.

The lock shaft 145 is configured to hold the ink cartridge 30 attached to the cartridge-attachment portion 110 at the attached position. The ink cartridge 30 is engaged with the lock shaft 145 in a state where the ink cartridge 30 is attached to the cartridge-attachment portion 110. Accordingly, the lock shaft 145 holds the ink cartridge 30 against urging forces of a coil spring 78 and a coil spring 98 of the ink cartridge 30 that push the ink cartridge 30 frontward.

<Tank 103>

As illustrated in FIGS. 4 through 6, the four tanks 103 are provided at a rear portion of the case 101. Each of the tanks 103 has a generally box shape and includes therein a storage chamber 121, a buffer chamber 122, and a flow passage 123. The storage chamber 121 and the buffer chamber 122 are arranged in the up-down direction 7. Specifically, the buffer chamber 122 is disposed above the storage chamber 121. The storage chamber 121 and the buffer chamber 122 are in communication with each other through the flow passage 123. The flow passage 123 is positioned above the storage chamber 121 and extends in the up-down direction 7. The storage chamber 121 extends frontward further than the flow passage 123 does. The storage chamber 121 is substantially rectangular in cross-section taken along a horizontal plane. A cross-sectional area of the storage chamber 121 taken along the horizontal plane is greater than a cross-sectional area of the flow passage 123 taken along the horizontal plane.

The storage chamber 121 is in communication with the internal space 117 of the ink needle 102 at a front end of the storage chamber 121. Specifically, the storage chamber 121 has a front wall 121A defining the front end of the storage chamber 121. The front wall 121A is formed with a communication port 129. The storage chamber 121 is in communication with the internal space 117 of the ink needle 102 through the communication port 129. With this configuration, ink flowing out of the ink cartridge 30 through the ink needle 102 is configured to be stored in the storage chamber 121.

In the tank 103, a projecting portion 120 is formed at a position above the storage chamber 121 and frontward of the flow passage 123. An internal space of the projecting portion 120 is in communication with the storage chamber 121. The projecting portion 120 has side walls facing in the left-right direction 9 and each of the side walls is made of a translucent or light-transmissive member. An arm 53 and a detected portion 54 of a pivoting member 50 (described later) are disposed in the projecting portion 120.

The storage chamber 121 is in communication with a corresponding ink flow passage 126 (see FIG. 5) through a communication port 128. The storage chamber 121 has a bottom wall 121B defining a bottom end of the storage chamber 121. The communication port 128 is formed in the bottom wall 121B of the storage chamber 121. The communication port 128 is positioned downward relative to the connecting portion 107.

The ink flow passage 126 extends upward from the storage chamber 121 and continuous to an ink outflow port 127. Corresponding one of the ink tubes 20 is connected to the ink outflow port 127. This configuration allows the ink stored in the storage chamber 121 to flow out of the storage chamber 121 through the communication port 128 to be supplied to the recording head 21 through the ink flow passage 126 and the ink tube 20.

The buffer chamber 122 is in communication with a corresponding one of two air communication ports 124 provided at an upper portion of the tank 103. Specifically, the buffer chamber 122 has a front wall 122A formed with a through-hole 119 (see FIG. 6). The through-hole 119 is sealed with a semipermeable membrane 118. Through the through-hole 119, the buffer chamber 122 is in communication with an air flow path (not shown) that is in communication with the corresponding air communication port 124. Each of the buffer chambers 122 is in communication with each other through this air flow path (not shown). Each air communication port 124 is configured to be open to the outside by means of a switching portion 56 (see FIGS. 6 and 8, described later). With this configuration, the respective storage chambers 121 and buffer chambers 122 can be open to an atmosphere. That is, each of the two air communication ports 124 allows the storage chambers 121 and the buffer chambers 122 to communicate with the atmosphere.

In FIG. 5, a film constituting a rear surface of each tank 103 is omitted. Each of the storage chamber 121, the buffer chamber 122, the flow passage 123, and the ink flow passage 126 has a rear end sealed with the film.

<Pivoting Member 50>

As illustrated in FIG. 6, the pivoting member 50 is disposed in the storage chamber 121 of each tank 103. The pivoting member 50 is supported by a supporting member (not illustrated) disposed in the storage chamber 121 so as to be pivotally movable in directions of arrows 58 and 59. The pivoting member 50 may be supported by a member other than the supporting member. For example, the pivoting member 50 may be supported by walls of the case 101 that partitions the storage chamber 121.

The pivoting member 50 includes a float 51, a shaft 52, the arm 53, and the detected portion 54. The float 51 constitutes a lower portion of the pivoting member 50. The float 51 is made of a material having a specific gravity smaller than a specific gravity of the ink stored in the storage chamber 121. The shaft 52 protrudes from left and right surfaces of the float 51 in the left-right direction 9. Protruding ends of the shaft 52 are inserted into holes formed in the support member. With this configuration, the pivoting member 50 is supported by the supporting member so as to be pivotally movable about an axis of the shaft 52.

The arm 53 protrudes substantially upward from the float 51. The detected portion 54 is provided at a protruding tip portion of the arm 53. The arm 53 and the detected portion 54 are located in the internal space of the projecting portion 120. The detected portion 54 has a plate shape extending in the up-down direction 7 and the front-rear direction 8. The detected portion 54 is made of a material that can block light emitted from a light-emitting portion of the corresponding liquid-level sensor 55 (described later).

When a liquid level of the ink stored in the storage chamber 121 is higher than a position P1 of the connecting portion 107 (more specifically, a position of the communication port 129) in the up-down direction 7, in other words, when the liquid level of the ink stored in the storage chamber 33 of the ink cartridge 30 is higher than the position P1 of the ink supply portion 34 (more specifically, a position of the ink supply port 71) in the up-down direction 7, the pivoting member 50 pivotally moves in the direction of the arrow 58 due to buoyancy acting on the float 51. As a result, the pivoting member 50 is positioned at a detection position indicated by a solid line in FIG. 6.

In the present embodiment, the position P1 is at the same height as a central axis of the ink needle 102 and is also at the same height as the center of the ink supply port 71 in the up-down direction 7. However, the position P1 may not necessarily be this position, provided that the position P1 is at the same height as the communication port 129 of the connecting portion 107 and the ink supply portion 34 in the up-down direction 7. For example, the position P1 may be at the same height as an upper end or a lower end of the ink needle 102, or may be at the same height as an upper end or a lower end of the ink supply port 71.

As the ink stored in the storage chamber 121 and in the ink valve chamber 35 is consumed and the liquid level of the ink stored in the storage chamber 121 is lowered to a position equal to or lower than the position P1 in the up-down direction 7, the pivoting member 50 pivotally moves in the direction of the arrow 59 following the liquid level of the ink stored in the storage chamber 121. As a result, the pivoting member 50 is positioned at a non-detection position indicated by a broken line in FIG. 6. That is, the pivoting member 50 is configured to change its posture (pivot) depending on whether the liquid level of the ink stored in the storage chamber 121 is at the same position (at the same height) as the connecting portion 107 in the up-down direction 7.

<Liquid-Level Sensor 55>

The liquid-level sensor 55 (see FIGS. 6 and 8) is provided to detect the change in posture of the corresponding pivoting member 50 provided with the detected portion 54. In the present embodiment, each liquid-level sensor 55 includes a light-emitting portion and a light-receiving portion. The light-emitting portion and the light-receiving portion of the liquid-level sensor 55 are arranged spaced apart from each other in the left-right direction 9, with the projecting portion 120 of the tank 103 interposed therebetween. The light-emitting portion of the liquid-level sensor 55 is disposed at rightward or leftward relative to the projecting portion 120, while the light-receiving portion of the liquid-level sensor 55 is disposed at the other side of the light-emitting portion relative to the projecting portion 120. A path of light outputted from the light-emitting portion of the liquid-level sensor 55 coincides with the left-right direction 9. When the pivoting member 50 is positioned at the detection position, the detected portion 54 of the pivoting member 50 is positioned between the light-emitting portion and the light-receiving portion of the liquid-level sensor 55.

The liquid-level sensor 55 is configured to output detection different signals depending on whether or not the light outputted from the light-emitting portion of the liquid-level sensor 55 is received by the light-receiving portion of the liquid-level sensor 55. For example, the liquid-level sensor 55 is configured to output a low-level signal (a signal whose signal level is lower than a threshold level) to the controller 130 (see FIG. 8) in case that the light-receiving portion of the liquid-level sensor 55 does not receive the light outputted from the light-emitting portion of the liquid-level sensor 55 (that is, an intensity of the light received at the light-receiving portion of the liquid-level sensor 55 is less than a predetermined intensity). On the other hand, the liquid-level sensor 55 is configured to output a high-level signal (a signal whose signal level is equal to or higher than the threshold level) to the controller 130 in case that the light-receiving portion of the liquid-level sensor 55 receives the light outputted from the light-emitting portion of the liquid-level sensor 55 (that is, the intensity of the light received at the light-receiving portion is equal to or higher than the predetermined intensity).

As illustrated in FIG. 6, when the pivoting member 50 is at the detection position, the detected portion 54 is positioned between the light-emitting portion and the light-receiving portion of the corresponding liquid-level sensor 55. Thus, in case that the liquid level of the ink stored in the storage chamber 121 of the tank 103 (in other words, the liquid level of the ink stored in the storage chamber 33 of the ink cartridge 30) is higher than the position P1 in the up-down direction 7, the light-receiving portion of the liquid-level sensor 55 does not receive the light outputted from the light-emitting portion of the liquid-level sensor 55. Accordingly, the liquid-level sensor 55 outputs the low-level signal to the controller 130.

On the other hand, when the pivoting member 50 is at the non-detection position, the detected portion 54 is retracted from the position between the light-emitting portion and the light-receiving portion of the liquid-level sensor 55. Thus, in case that the liquid level of the ink stored in the storage chamber 121 of the tank 103 (in other words, the liquid level of the ink stored in the storage chamber 33 of the ink cartridge 30) is equal to or lower than the position P1 in the up-down direction 7, the light-receiving portion of the liquid-level sensor 55 receives the light outputted from the light-emitting portion of the liquid-level sensor 55. Accordingly, the liquid-level sensor 55 outputs the high-level signal to the controller 130.

<Switching Portion 56>

The switching portion 56 is in communication with the two air communication ports 124 provided for the respective tanks 103 through a tube 175 (see FIG. 6). Specifically, one end of the tube 175 is in communication with each of the air communication ports 124, while the other end of the tube 175 is in communication with the switching portion 56.

Specifically, in the present embodiment, the switching portion 56 is in communication with each of the two air communication ports 124. One of the two air communication ports 124 is in communication with the tank 103 corresponding to the ink cartridge 30 storing ink of black color. The other one of the two air communication ports 124 is in communication with each of the three tanks 103 corresponding to the ink cartridges 30 storing ink of respective colors of magenta, cyan and yellow.

The switching portion 56 is configured to switch status of each of the two air communication ports 124 between a first state and a second state. Here, the first state represents a state in which air flow from the air communication port 124 to the outside of the cartridge-attachment portion 110 through the tube 175 is established. The second state represents a state in which air flow from the air communication port 124 to the outside of the cartridge-attachment portion 110 through the tube 175 is interrupted.

For example, the switching portion 56 may include a hollow cylinder, and a cylindrical-shaped rotary body disposed inside the hollow cylinder. The hollow cylinder has an inner peripheral surface formed with an air communication port 56A (see FIG. 6). The air communication port 56A is in communication with the atmosphere. The rotary body has an outer peripheral surface formed with a connection port (not shown). The connection port is in communication with the tube 175. The rotary body is configured to rotate upon receipt of drive force from a switching-portion driving motor 174. When the connection port comes to a position opposing the air communication port 56A in accordance with rotation of the rotary body, the air communication ports 124 become the first state where circulation of air through the tube 175, the connection port and the air communication port 56A is allowed. On the other hand, when the connection port is positioned so as not to face the air communication port 56A in accordance with rotation of the rotary body, communication of air between the connection port and the air communication port 56A is interrupted, rendering the air communication ports 124 into the second state where air flow is not allowed.

Both of the air communication ports 124 become the first state in case that the rotary body rotates to such a prescribed position that the connection port and the air communication port 56A oppose each other. On the other hand, both of the air communication ports 124 become the second state in case that the rotary body rotates to such a prescribed position that the connection port and the air communication port 56A do not oppose each other. With this structure, operations of the single switching portion 56 can realize switching of the status of both of the two air communication ports 124.

Incidentally, the configuration for allowing and interrupting air flow should not be limited to the above-described structure, but various configurations well-known in the art may be employed.

Correspondence relationship between the switching portion 56 and the four tanks 103 (air communication port 124) should not be limited to the depicted one. For example, two switching portions 56 may be provided, instead of one switching portion 56. In this case, one of the two switching portions 56 may be configured to communicate with one of the two air communication ports 124 that is in communication with the tank 103 corresponding to the ink cartridge 30 storing ink of black color. The other one of the two switching portions 56 may be configured to communicate with the other air communication port 124 that is in communication with each of the three tanks 103 corresponding to the ink cartridges 30 storing ink of colors of magenta, cyan and yellow, respectively. Alternatively, four switching portions 56 and four air communication ports 124 may be provided each for each of the four tanks 103. With this structure, operations of each switching portion 56 can realize switching of the status of the corresponding one of the four air communication ports 124 for the respective four tanks 103, individually.

<Open/Close Sensor 57>

An open/close sensor 57 (see FIG. 8) is configured to detect the position of the rotary body of the switching portion 56. As an example, the open/close sensor 57 is configured to output a low-level signal (a signal whose signal level is lower than a threshold level) to the controller 130 in case that the rotary body rotates to the prescribed position at which the connection port and the air communication port 56A oppose each other. On the other hand, the open/close sensor 57 is configured to output a high-level signal (a signal whose signal level is equal to or higher than the threshold level) to the controller 130 in case that the rotary body rotates to the prescribed position at which the connection port and the air communication port 56A do not oppose each other.

In other words, the open/close sensor 57 is configured to output the low-level signal when the corresponding air communication port 124 is in the first state, while the open/close sensor 57 is configured to output the high-level signal when the corresponding air communication port 124 is in the second state. Note that, various conventional sensors (a proximity sensor or an optical sensor) may be employed as the open/close sensor 57.

[Ink Cartridge 30]

Figure 7:
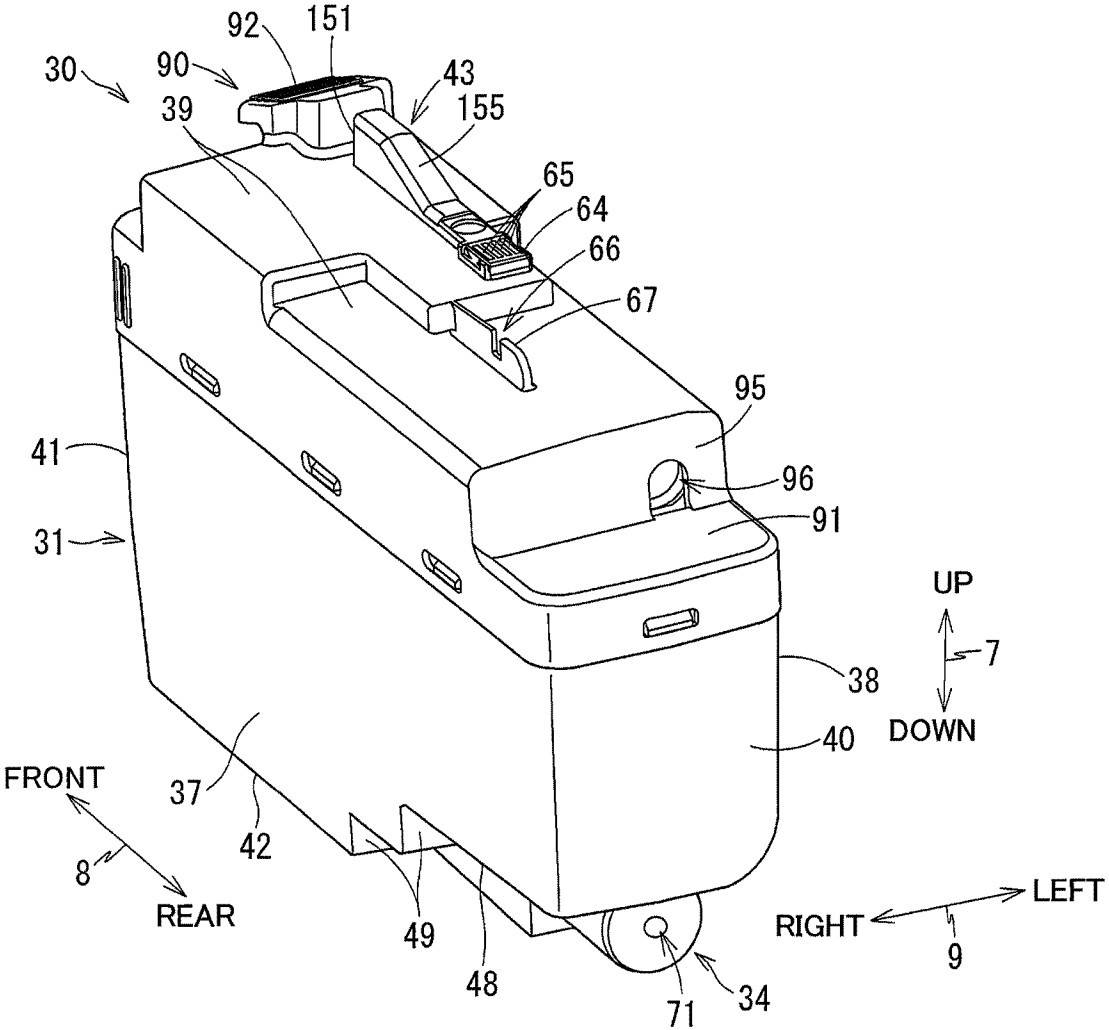
FIG. 7 is a perspective view of the ink cartridge as viewed from a rear side thereof according to the embodiment.

The ink cartridge 30 illustrated in FIGS. 6 and 7 is a container for storing ink therein. The posture of the ink cartridge 30 illustrated in FIGS. 6 and 7 is the operable posture of the ink cartridge 30, that is, a posture of the ink cartridge 30 when the ink cartridge 30 is capable of being used in the multifunction peripheral 10. As described above, in the embodiment, four ink cartridges 30 corresponding to respective four colors of cyan, magenta, yellow, and black can be attached to the cartridge-attachment portion 110.

As illustrated in FIGS. 6 and 7, the ink cartridge 30 includes a cartridge casing 31 that is substantially rectangular parallelepiped. The cartridge casing 31 includes a rear wall 40, a front wall 41, a top wall 39, a bottom wall 42, a right side wall 37, and a left side wall 38.

The cartridge casing 31 as a whole has a generally flattened shape so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. At least the front wall 41 of the cartridge casing 31 has light transmission capability so that a liquid level of the ink stored in a storage chamber 32 (described later) and the storage chamber 33 can be visually recognized from an outside of the cartridge casing 31.

The cartridge casing 31 further includes a subordinate bottom wall 48 and a stepped wall 49. The subordinate bottom wall 48 is positioned upward relative to the bottom wall 42 and extends frontward continuously from a lower end of the rear wall 40. The stepped wall 49 connects the bottom wall 42 to the subordinate bottom wall 48. The ink supply portion 34 extends rearward from the stepped wall 49 at a position downward relative to the subordinate bottom wall 48 and upward relative to the bottom wall 42. In the present embodiment, a rear end of the subordinate bottom wall 48 is positioned rearward relative to a rear end of the ink supply portion 34, while a front end of the subordinate bottom wall 48 is positioned frontward relative to the rear end of the ink supply portion 34. Incidentally, the rear end of the subordinate bottom wall 48 may be positioned at an arbitrary position. For example, the rear end of the subordinate bottom wall 48 may be positioned frontward relative to the rear end of the ink supply portion 34.

A protruding portion 43 is provided at an outer surface of the top wall 39 to protrude upward therefrom. The protruding portion 43 extends in the front-rear direction 8. The protruding portion 43 has a lock surface 151 facing frontward. The lock surface 151 is positioned upward relative to the top wall 39. The lock surface 151 is a surface facing frontward and configured to contact the lock shaft 145 in a state where the ink cartridge 30 is attached to the cartridge-attachment portion 110. The lock surface 151 comes into contact with the lock shaft 145 while pushing the lock shaft 145 frontward, so that the ink cartridge 30 is held in the cartridge-attachment portion 110 against the urging forces of the coil springs 78 and 98.

The protruding portion 43 also has an inclined surface 155. The inclined surface 155 is positioned rearward relative to the lock surface 151. During an attachment process of the ink cartridge 30 to the cartridge-attachment portion 110, the lock shaft 145 is guided by the inclined surface 155. As the lock shaft 145 moves along the inclined surface 155, the lock shaft 145 is guided to a position capable of contacting the lock surface 151.

An operation portion 90 is disposed frontward relative to the lock surface 151 on the top wall 39. The operation portion 90 has an operation surface 92. When the operation surface 92 is pushed downward in a state where the ink cartridge 30 is attached to the cartridge-attachment portion 110, the ink cartridge 30 is pivotally moved, thereby moving the lock surface 151 downward. As a result, the lock surface 151 is positioned further downward relative to the lock shaft 145. In this way, the ink cartridge 30 can be extracted from the cartridge-attachment portion 110.

The light-blocking plate 67 is provided at the outer surface of the top wall 39 to protrude upward therefrom. The light-blocking plate 67 extends in the front-rear direction 8. The light-blocking plate 67 is disposed rearward relative to the protruding portion 43.

The light-blocking plate 67 is disposed between the light-emitting portion and the light-receiving portion of the attachment sensor 113 in a state where the ink cartridge 30 is attached to the cartridge-attachment portion 110. Hence, the light-blocking plate 67 is configured to block the light emitted from the attachment sensor 113 and traveling in the left-right direction 9.

More specifically, when the light emitted from the light-emitting portion of the attachment sensor 113 is incident on the light-blocking plate 67 before the light arrives at the light-receiving portion of the attachment sensor 113, an intensity of the light received by the light-receiving portion of the attachment sensor 113 is less than a predetermined intensity, for example, zero. Note that the light-blocking plate 67 may completely block the light traveling from the light-emitting portion to the light-receiving portion, or may partially attenuate the light. Alternatively, the light-blocking plate 67 may refract the light to change a traveling direction thereof, or may fully reflect the light.

In the present embodiment, a notch 66 is formed in the light-blocking plate 67. The notch 66 is a space that is recessed downward from an upper edge of the light-blocking plate 67, and extends in the front-rear direction 8. Since the notch 66 is formed in the light-blocking plate 67 at a position opposing the attachment sensor 113 in a state where the ink cartridge 30 is attached to the cartridge-attachment portion 110, the light emitted from the light-emitting portion of the attachment sensor 113 passes through the notch 66 and is therefore not blocked by the light-blocking plate 67. Accordingly, the light emitted from the light-emitting portion of the attachment sensor 113 reaches the light-receiving portion of the attachment sensor 113. On the other hand, in case that the notch 66 is not formed in the light-blocking plate 67, the light-blocking plate 67 opposes the light-emitting portion of the attachment sensor 113 in a state where the ink cartridge 30 is attached to the cartridge-attachment portion 110. Accordingly, the light emitted from the light-emitting portion of the attachment sensor 113 does not reach the light-receiving portion of the attachment sensor 113. With this structure, types of the ink cartridges 30, such as types of ink stored in the ink cartridges 30, initial amounts of the ink stored in the ink cartridges 30, for example, can be determined based on whether or not the notch 66 is formed in the light-blocking plate 67 of each ink cartridge 30 attached to the cartridge-attachment portion 110.

An IC board 64 is provided at the outer surface of the top wall 39. The IC board 64 is positioned between the light-blocking plate 67 and the protruding portion 43 in the front-rear direction 8. The IC board 64 is electrically connected to the corresponding set of four contacts 106 in a state where the ink cartridge 30 is attached to the cartridge-attachment portion 110.

The IC board 64 includes a substrate made of silicon for example, an IC (not illustrated), and four electrodes 65. The IC and the four electrodes 65 are mounted on the substrate. The four electrodes 65 are arrayed in the left-right direction 9. The IC is a semiconductor integrated circuit. The IC readably stores data indicative of information on the ink cartridge 30, such as a lot number, a manufacturing date, a color of ink, and the like. Alternatively, the IC board 64 may be configured by providing the IC and the electrodes on a flexible substrate having flexibility.

Each of the four electrodes 65 is electrically connected to the IC. The four electrodes 65 each extend in the front-rear direction 8 and are arranged spaced apart from one another in the left-right direction 9. Each electrode 65 is provided on an upper surface of the IC board 64 and exposed to an outside to allow electrical access to the electrode 65.

The outer surface of the top wall 39 includes a subordinate top surface 91 at a rear end portion thereof. A stepped surface 95 extends upward from a front end of the subordinate top surface 91. The stepped surface 95 is a surface facing rearward. The air communication port 96 is formed in the stepped surface 95 to allow the storage chamber 32 to communicate with the atmosphere through the air communication port 96. In other words, the air communication port 96 is positioned higher relative to the center of the cartridge casing 31 in the up-down direction 7. The air communication port 96 is an opening formed in the stepped surface 95 and has a substantially circular shape.

The air communication port 96 has an inner diameter that is greater than an outer diameter of the rod 125 of the cartridge-attachment portion 110. In the attachment process of the ink cartridge 30 into the cartridge-attachment portion 110, as illustrated in FIG. 6, the rod 125 enters an air valve chamber 36 (described later) through the air communication port 96. As the rod 125 enters the air valve chamber 36 through the air communication port 96, the rod 125 moves a valve 97 (described later) configured to seal the air communication port 96 frontward against the urging force of the coil spring 98. When the valve 97 is moved frontward and separated from the air communication port 96, the storage chamber 32 is open to the atmosphere.

Incidentally, a member for sealing the air communication port 96 should not necessarily be the valve 97. For example, a removable seal may be provided at the stepped surface 95 to seal the air communication port 96.

As illustrated in FIG. 6, the storage chamber 32, the storage chamber 33, the ink valve chamber 35, and the air valve chamber 36 are provided within the cartridge casing 31. The storage chamber 32, the storage chamber 33, and the ink valve chamber 35 are configured to store ink therein. The air valve chamber 36 is configured to communicate with the atmosphere.

The storage chamber 32 and the storage chamber 33 are in communication with each other through a through-hole (not illustrated).

The storage chamber 32 and the air valve chamber 36 are in communication with each other through a through-hole 46.

The storage chamber 33 and the ink valve chamber 35 are in communication with each other through a through-hole 99 formed in a lower end portion of the storage chamber 33.

The valve 97 and the coil spring 98 are accommodated in the air valve chamber 36. The air valve chamber 36 is in communication with the atmosphere through the air communication port 96 formed in the stepped surface 95. The valve 97 is movable between a closed position and an open position. At the closed position, the valve 97 seals the air communication port 96. At the open position, the valve 97 is separated from the air communication port 96. The coil spring 98 is disposed in the air valve chamber 36 so as to be able to expand and contract in the front-rear direction 8. The coil spring 98 urges the valve 97 in such a direction that the valve 97 contacts the air communication port 96. That is, the coil spring 98 urges the valve 97 rearward. The coil spring 98 has a spring constant that is smaller than a spring constant of the coil spring 78 of the ink supply portion 34.

The air valve chamber 36 includes a wall 93 partitioning an internal space of the air valve chamber 36 in the front-rear direction 8. The wall 93 is formed with a through-hole 94. The through-hole 94 is sealed with a semipermeable membrane 80. The storage chamber 32 is in communication with the air valve chamber 36 through the through-hole 46 and the through-hole 94.

The ink supply portion 34 protrudes rearward from the stepped wall 49. The ink supply portion 34 has a cylindrical outer shape. The ink supply portion 34 defines therein an inner space serving as the ink valve chamber 35. The ink supply portion 34 has a rear end that is open to the outside of the ink cartridge 30 through the ink supply port 71. A seal member 76 is provided at the rear end of the ink supply portion 34. The ink supply portion 34 has a front end that is in communication with the lower end portion of the storage chamber 33 through the through-hole 99, as described above. That is, the ink supply portion 34 is in communication with the lower end portion of the storage chamber 33.

A valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Accordingly, the valve 77 closes off the ink supply port 71 formed in the seal member 76 in a state where no external force is applied to the valve 77.

The seal member 76 is a disk-shaped member in which a through-hole is formed at its center portion. The seal member 76 is made of, for example, an elastic material such as rubber or elastomer. A cylindrical inner peripheral surface defining the through-hole penetrating the center portion of the seal member 76 in the front-rear direction 8 defines the ink supply port 71. The ink supply port 71 has an inner diameter slightly smaller than an outer diameter of the ink needle 102.

When the ink cartridge 30 is attached to the cartridge-attachment portion 110 in a state where the valve 77 closes the ink supply port 71 and the valve 114 closes the opening 116 of the ink needle 102, the ink needle 102 enters into the ink supply port 71. That is, the connecting portion 107 and the ink supply portion 34 are connected to each other. At this time, the outer peripheral surface of the ink needle 102 provides liquid-tight contact with the inner peripheral surface of the seal member 76 that defines the ink supply port 71, while elastically deforming the seal member 76. As the tip end of the ink needle 102 passes through the seal member 76 and advances into the ink valve chamber 35, the tip end of the ink needle 102 abuts on the valve 77. When the ink cartridge 30 is further inserted into the cartridge-attachment portion 110, the ink needle 102 moves the valve 77 frontward against the urging force of the coil spring 78, thereby opening the ink supply port 71.

Further, while the tip end of the ink needle 102 abuts on the valve 77, the valve 77 abuts on the valve 114 from a front side thereof and pushes the valve 114 rearward. Hence, the valve 114 moves rearward against the urging force of the coil spring 115. Thus, the opening 116 is open. As a result, the ink stored in the storage chamber 32, the storage chamber 33, and ink valve chamber 35 can flow into the storage chamber 121 of the tank 103 through the internal space 117 of the ink needle 102. Since each of the storage chamber 32, the storage chamber 33, the ink valve chamber 35 and the storage chamber 121 is in communication with the atmosphere, the ink stored in the storage chamber 32 and the storage chamber 33 and the ink valve chamber 35 of the ink cartridge 30 is supplied to the storage chamber 121 of the tank 103 through the ink supply portion 34 due to hydraulic head difference.

Note that, in a state where each ink cartridge 30 is attached to the cartridge-attachment portion 110, since the ink supply portion 34 and its corresponding connecting portion 107 are connected to each other, the storage chamber 121 of each tank 103 is in communication with the storage chambers 32 and 33 that are in communication with the atmosphere through the air communication port 96 of each ink cartridge 30. That is, in a state where each ink cartridge 30 is attached to the cartridge-attachment portion 110, each storage chamber 121 can communicate with the atmosphere at least through the corresponding air communication port 96 of the attached ink cartridge 30, regardless of whether the corresponding air communication port 124 is in the first state or in the second state. With this structure, the ink stored in each storage chamber 121 is allowed to be supplied to the recording portion 24 through the corresponding ink tube 20. The ink can therefore be ejected through the nozzles 29 so that images can be recorded on the sheets 12.

[Controller 130]

Figure 8:
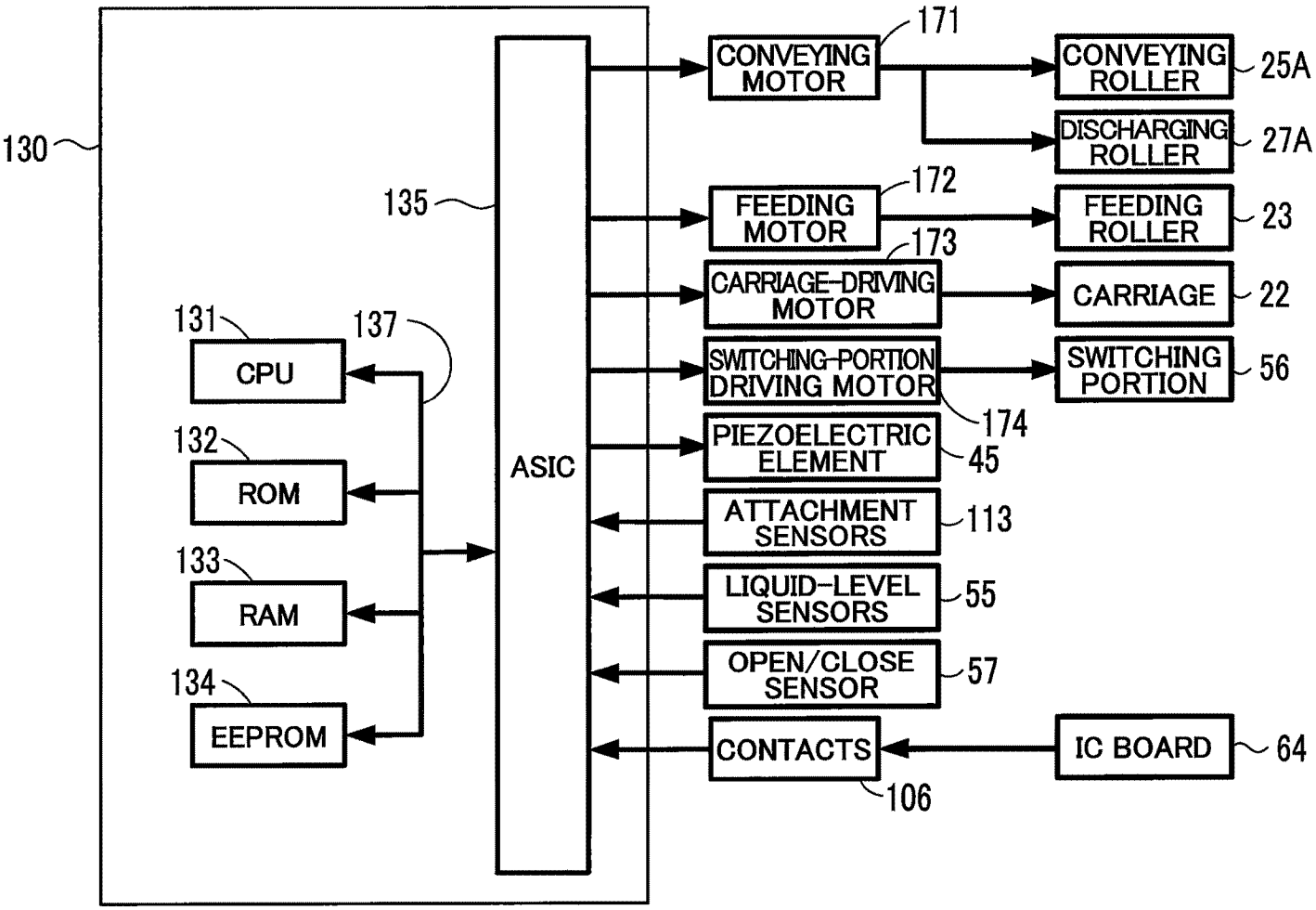
FIG. 8 is a block diagram illustrating a configuration of a controller of the multifunction peripheral according to the embodiment.

Next, a schematic configuration of the controller 130 will be described with reference to FIG. 8.

The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like according to which the CPU 131 can perform various control operations including an image-recording control operation. The RAM 133 is used as a storage area for temporarily storing data, signals, and the like used when the CPU 131 executes the programs. The EEPROM 134 stores settings, flags, and the like that need to be preserved after the multifunction peripheral 10 is turned off.

The conveying motor 171, the feeding motor 172, and the carriage-driving motor 173 are connected to the ASIC 135. Further, the switching-portion driving motor 174 for driving the switching portions 56 is also connected to the ASIC 135. The ASIC 135 includes drive circuits for controlling these motors. When the CPU 131 inputs a drive signal for rotating each motor into a corresponding drive circuit thereof, a drive current corresponding to the drive signal is configured to be outputted from the drive circuit to the corresponding motor, thereby rotating the motor. That is, the controller 130 is configured to control driving of the motors 171, 172, 173, and 174.

Further, signals outputted from the respective attachment sensors 113 are configured to be inputted into the ASIC 135. In case that a signal inputted from the attachment sensor 113 is low level, the controller 130 determines that the ink cartridge 30 has been attached to the cartridge-attachment portion 110. On the other hand, the controller 130 determines that the ink cartridge 30 has not been attached to the cartridge-attachment portion 110 in case that a high level signal is inputted from the attachment sensor 113.

Further, signals outputted from each liquid-level sensor 55 are configured to be inputted into the ASIC 135. When a low level signal is inputted from the liquid-level sensor 55, the controller 130 determines that the liquid level of the ink stored in the storage chamber 121 of the tank 103 and the liquid level of the ink stored in the storage chamber 33 of the ink cartridge 30 are positioned higher than the position P1 in the up-down direction 7. On the other hand, when a high level signal is inputted from the liquid-level sensor 55, the controller 130 determines that the liquid level of the ink stored in the storage chamber 121 of the tank 103 and the liquid level of the ink stored in the storage chamber 33 of the ink cartridge 30 are lower than or equal to the position P1 in the up-down direction 7. In case that the controller 130 determines that the liquid level of the ink is lower than or equal to the position P1 in the up-down direction 7, the controller 130 notifies the user that the ink cartridge 30 needs to be replaced, by displaying a warning message on a display, lighting an LED, emitting a warning sound, for example.

The controller 130 is configured to determine the position of the liquid level of the ink stored in the storage chamber 33 in the up-down direction 7 for each of the four ink cartridges 30. That is, the controller 130 determines the position of the liquid level of the ink stored in the storage chamber 121 in the up-down direction 7 for each of the tanks 103 corresponding to the four ink cartridges 30.

The piezoelectric element 45 is also connected to the ASIC 135. The piezoelectric element 45 is configured to operate upon receipt of electric power supplied by the controller 130 via a drive circuit (not illustrated). The controller 130 is configured to control power supply to the piezoelectric element 45 such that ink droplets can be ejected selectively through the plurality of nozzles 29.

Further, signals outputted from the open/close sensor 57 are also configured to be inputted into the ASIC 135. In case that a low level signal is inputted from the open/close sensor 57, the controller 130 determines that the corresponding air communication port 124 is in the first state. On the other hand, in case that a high level signal is inputted from the open/close sensor 57, the controller 130 determines that the corresponding air communication port 124 is in the second state.

When recording an image on the sheet 12, the controller 130 is configured to control the conveying motor 171 to cause the conveying rollers 25 and the discharging rollers 27 to execute an intermittent conveying process. The intermittent conveying process is a process in which the conveying rollers 25 and the discharging rollers 27 alternately repeat conveyance of the sheet 12 and halting of the conveyance of the sheet 12 by predetermined line feeds.

The controller 130 is configured to execute an ejection process while the conveyance of the sheet 12 is halted in the intermittent conveying process. The ejection process is a process in which the controller 130 controls the power supply to the piezoelectric element 45 to allow ink droplets to be ejected from the nozzles 29 while moving the carriage 22 in the left-right direction 9. That is, when the controller 130 executes the ejection process, ink droplets are ejected from the nozzles 29 during a single pass (hereinafter also referred to as "one pass") in which the carriage 22 moves from one end to the other end of a prescribed printing range. Hence, one pass worth of an image is recorded on the sheet 12.

By alternately performing the intermittent conveying process and the ejection process, an image can be recorded in an entirety of an image-recordable region of each sheet 12.

The controller 130 is configured to execute a series of processes to record an image on the sheet 12 by controlling each of the motors 171, 172, and 173, and the piezoelectric element 45 based on the signals outputted from the sensors 55 and 113 to the controller 130. The series of processes are configured to be initiated upon receipt of an image-recording command to instruct image recording on the sheet 12 at the controller 130 from an external device connected to the multifunction peripheral 10 or from an operation interface 179 (see FIG. 1) of the multifunction peripheral 10. The series of processes includes: feeding the sheet 12 supported by the feeding tray 15 to the conveying path 17 with the feeding roller 23; conveying in the conveying direction the sheet 12 fed onto the conveying path 17 with the conveying rollers 25 and the discharging rollers 27; recording an image on the sheet 12 conveyed through the conveying path 17 by executing the intermittent conveying process and the ejection process; and discharging the image-recorded sheet 12 to the discharge tray 16 with the discharging rollers 27.

[Operations to Switch Air Communication State]

Hereinafter, various processes executed by the controller 130 for switching air communication status at the tanks 103 of the cartridge-attachment portion 110 will be described while referring to the flowcharts of FIGS. 9 through 13.

How the controller 130 switches the air communication status at the tank 103 corresponding to the ink cartridge 30 storing black ink (hereinafter, to be referred to as "black ink cartridge 30") in various situations will be first described while referring to the flowcharts of FIGS. 9 through 11.

First, referring to FIG. 9, how the controller 130 switches the air communication status at the tank 103 corresponding to the black ink cartridge 30 is switched in a state where the ink cartridge 30 is attached to the cartridge-attachment portion 110 will be described. That is, the flowchart of FIG. 9 is configured to be executed in a state where a low level signal is transmitted from the corresponding attachment sensor 113 to the controller 130.

Note that, as an initial state, the air communication port 124 corresponding to the black ink cartridge 30 is in the first state. That is, the air communication port 124 corresponding to the black ink cartridge 30 is in communication with the atmosphere when the controller 130 launches the process of FIG. 9.

Figure 9:
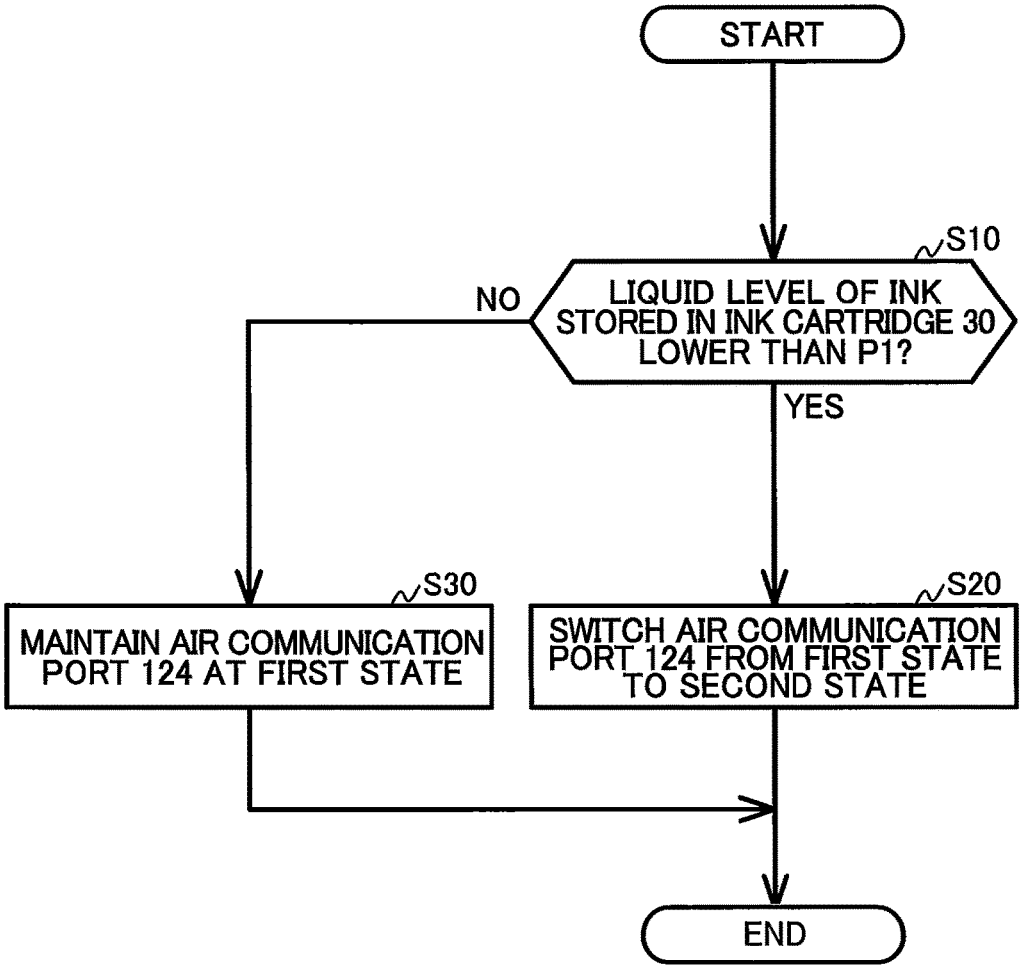
FIG. 9 is a flowchart illustrating steps in a process executed by the controller for switching air communication status in a state where the ink cartridge storing ink of black color is attached to the cartridge-attachment portion according to the embodiment.

First, in S10 of FIG. 9, the controller 130 determines whether or not the liquid level of the black ink stored in the attached black ink cartridge 30 is higher than the position P1 (see FIG. 6) based on the signal outputted from the corresponding liquid-level sensor 55.

In case that the liquid level of the black ink stored in the black ink cartridge 30 is equal to or lower than the position P1 (S10:YES), the controller 130 drives the switching-portion driving motor 174 in S20 to switch the air communication port 124 corresponding to the black ink cartridge 30 from the first state to the second state. That is, when the liquid level of the black ink stored in the attached black ink cartridge 30 falls below the position P1, an amount of air that circulates at the tank 103 storing black ink is reduced, since the storage chamber 121 is allowed to communicate with the atmosphere only through the air communication port 96 of the black ink cartridge 30. Accordingly, evaporation of the ink stored in the storage chamber 121 corresponding to the black ink cartridge 30 can be suppressed.

On the other hand, in case that the liquid level of the black ink stored in the black ink cartridge 30 is determined to be higher than the position P1 (S10:NO), the controller 130 maintains the air communication port 124 at its first state in S30. With this structure, a sufficient amount of air is ensured to be circulated at the tank 103 corresponding to the black ink cartridge 30, since the storage chamber 121 storing black ink can communicate with the atmosphere not only through the corresponding air communication port 96 but also through the corresponding air communication port 124.

Next, with reference to the flow chart of FIG. 10, how the controller 130 switches the air communication status at the tank 103 corresponding to the black ink cartridge 30 in a state where the black ink cartridge 30 is detached from the cartridge-attachment portion 110 will be described.

Figure 10:
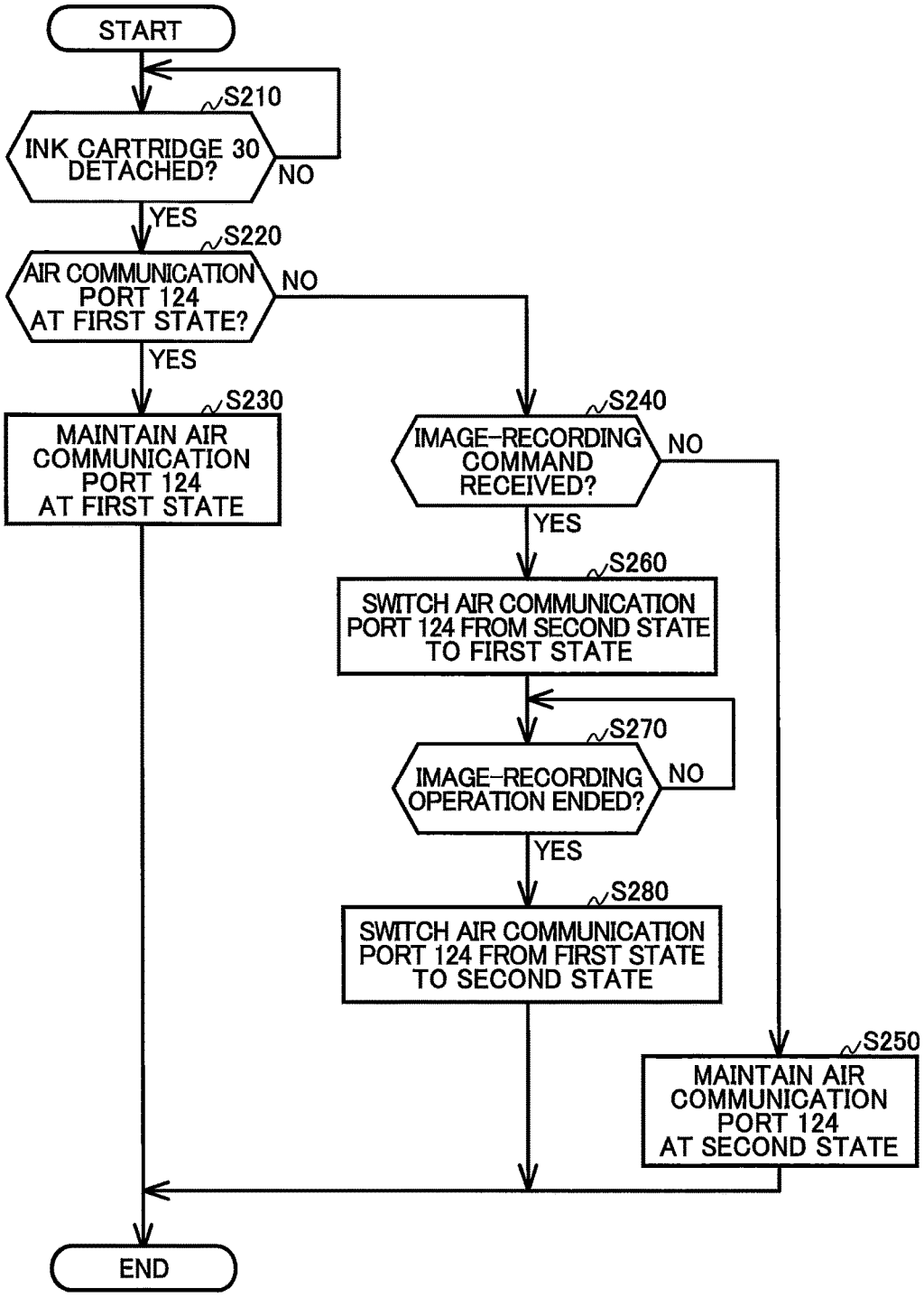
FIG. 10 is a flowchart illustrating steps in a process executed by the controller for switching air communication status in a state where the ink cartridge storing ink of black color is not attached to the cartridge-attachment portion according to the embodiment.

Referring to FIG. 10, the controller 130 first determines in S210 whether or not the black ink cartridge 30 is detached from the cartridge-attachment portion 110, based on the signals outputted from the corresponding attachment sensor 113.

The controller 130 determines that the black ink cartridge 30 is attached to the cartridge-attachment portion 110 (S210: NO) upon receipt of the low signal outputted from the corresponding attachment sensor 113. The controller 130 repeats this step S210 as long as the controller 130 receives the low signal from the corresponding attachment sensor 113.

In case that the signal from the corresponding attachment sensor 113 is changed from the low level signal to the high level signal, the controller 130 determines in S210 that the black ink cartridge 30 is detached from the cartridge-attachment portion 110 (S210: YES).

The controller 130 then determines in S220 whether or not the air communication port 124 of the tank 103 corresponding to the black ink cartridge 30 is in the first state, based on the signals outputted from the open/close sensor 57.

In case that the air communication port 124 is in the first state (S220: YES), the controller 130 maintains the air communication port 124 at the first state in S230. Note that, here, the controller 130 may switch the air communication port 124 from the first state to the second state.

Oh the other hand, in case that the air communication port 124 is determined to be in the second state in S220 (S220: NO), the controller 130 then determines in S240 whether or not an image-recording command is transmitted from an external device connected to the multifunction peripheral 10 or from the operation interface 179 of the multifunction peripheral 10.

In case that no image-recording command is determined to be transmitted to the controller 130, i.e., an image-recording operation is not instructed (S240:NO), the controller 130 maintains the air communication port 124 at the second state in S250. That is, the air communication port 124 corresponding to the black ink cartridge 30 is shut off from the atmosphere.

On the other hand, in case that an image-recording command is determined to be transmitted to the controller 130 in S240, i.e., an image-recording operation is instructed (S240:YES), the controller 130 then drives the switching-portion driving motor 174 to switch the air communication port 124 from the second state to the first state in S260. That is, the air communication port 124 is open to the atmosphere to secure a sufficient amount of air flow at the tank 103 so that the image-recording operations in black ink can be performed at the multifunction peripheral 10.

Note that, since the air communication port 124 is in the first state, the image-recording operation can be performed as long as ink is available in the storage chamber 121, even if the ink cartridge 30 is detached from the cartridge-attachment portion 110.

After the series of processes to record images on the sheet(s) 12 (image-recording operation) is completed and ended (S270: YES), the controller 130 then drives the switching-portion driving motor 174 in S280 to switch the air communication port 124 from the first state back to the second state. That is, the air communication port 124 corresponding to the black ink cartridge 30 is again shut off from the atmosphere.

Next, with reference to the flow chart of FIG. 11, description will be given on how the controller 130 switches the air communication status at the tank 103 corresponding to the black ink cartridge 30 in a state where a new black ink cartridge 30 is attached to the cartridge-attachment portion 110 after the ink cartridge 30 storing black ink whose liquid level is determined to be equal to or lower than the position P1 is detached from the cartridge-attachment portion 110.

Note that, the black ink cartridge 30 is removed from the cartridge-attachment portion 110 after the liquid level of the ink stored in the black ink cartridge 30 becomes equal to or lower than the position P1 in the up-down direction 7. This means that the step S20 in the flowchart of FIG. 9 was already executed by the controller 130. Accordingly, the air communication port 124 is at the second state, as its initial state, when the controller 130 starts executing the process of FIG. 11.

Figure 11:
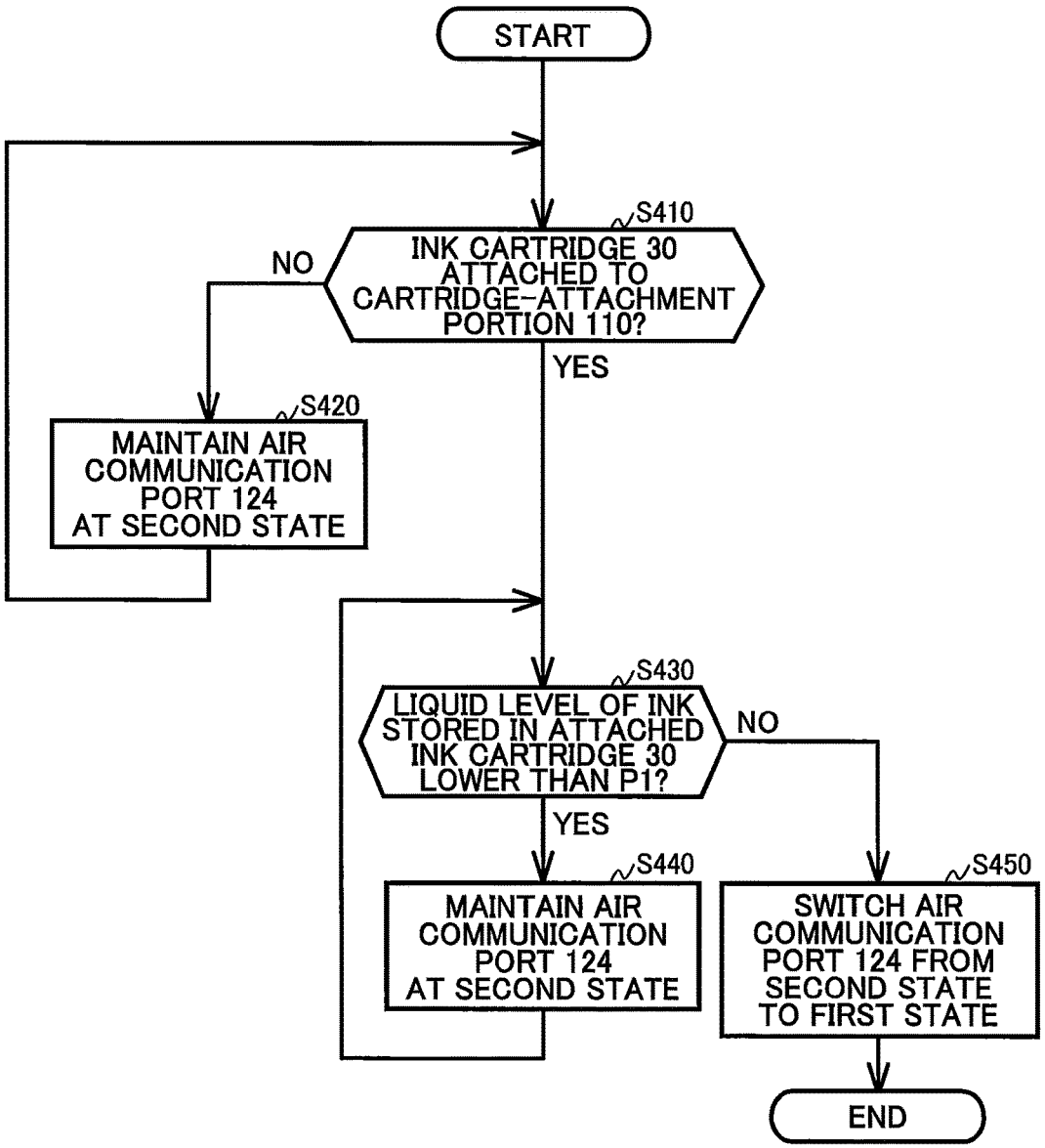
FIG. 11 is a flowchart illustrating steps in a process executed by the controller for switching air communication status in a state where a new ink cartridge storing ink of black color is attached to the cartridge-attachment portion according to the embodiment.

That is, the controller 130 initiates the process of FIG. 11 in case that the controller 130 determines that the black ink cartridge 30 is used up and detached from the cartridge-attachment portion 110 due to the change in the signal outputted to the controller 130 from the corresponding attachment sensor 113 from the low level signal to the high level signal.

Referring to FIG. 11, the controller 130 first determines in S410 whether or not a new black ink cartridge 30 is attached to the cartridge-attachment portion 110 based on the signals transmitted from the corresponding attachment sensor 113.

The controller 130 determines in S410 that a new black ink cartridge 30 is not attached to the cartridge-attachment portion 110 as long as the signal outputted from the attachment sensor 113 remains at the high level. The controller 130 maintains the air communication port 124 at the second state in S420 until a new black ink cartridge 30 is determined to be attached to the cartridge-attachment portion 110 (S410: NO).

On the other hand, the controller 130 determines in S410 that a new black ink cartridge 30 is attached to the cartridge-attachment portion 110 (S410:YES) in case that the signal outputted from the corresponding attachment sensor 113 is changed from the high level signal to the low level signal.

The controller 130 then refers to the signal outputted from the corresponding liquid-level sensor 55 in S430 to determine whether or not the liquid level of the black ink stored in the storage chamber 121 of the corresponding tank 103 is equal to or lower than the position P1.

Note that, the liquid level of the ink stored in the storage chamber 121 of the corresponding tank 103 is still lower than or equal to the position P1 immediately after a new ink cartridge 30 is attached to the cartridge-attachment portion 110. That is, the signal outputted from the corresponding liquid-level sensor 55 is the high level signal. The controller 130 thus determines YES in S430 and advances to S440 to maintain the air communication port 124 at the second state.

As time elapses after the new black ink cartridge 30 is attached to the cartridge-attachment portion 110, the ink stored in the storage chambers 32 and 33 of the attached black ink cartridge 30 flows into the storage chamber 121 of the corresponding tank 103 through the corresponding connecting portion 107 and ink supply portion 34. The liquid level of the black ink stored in the storage chamber 121 therefore rises upward to become higher than the position P1.

At this time, since the liquid level of the black ink in the storage chamber 121 is now positioned above the position P1, the pivoting member 50 is caused to pivot in the direction of the arrow 58, causing the signal from the corresponding liquid-level sensor 55 to change from the high level signal to the low level signal.

Due to this change in signal outputted from the corresponding liquid-level sensor 55, the controller 130 determines in S430 that the liquid level of the black ink stored in the attached black ink cartridge 30 is higher than the position P1 (S430:NO). The controller 130 then drives the switching-portion driving motor 174 in S450 to switch the air communication port 124 from the second state to the first state. The air communication port 124 is thus made in communication with the atmosphere.

Next, how the controller 130 switches the air communication status at the remaining three tanks 103 corresponding to the ink cartridges 30 storing ink of respective colors of cyan, magenta and yellow (hereinafter, to be referred to as "color ink cartridges 30") will be described with reference to FIGS. 12 and 13.

Figure 12:
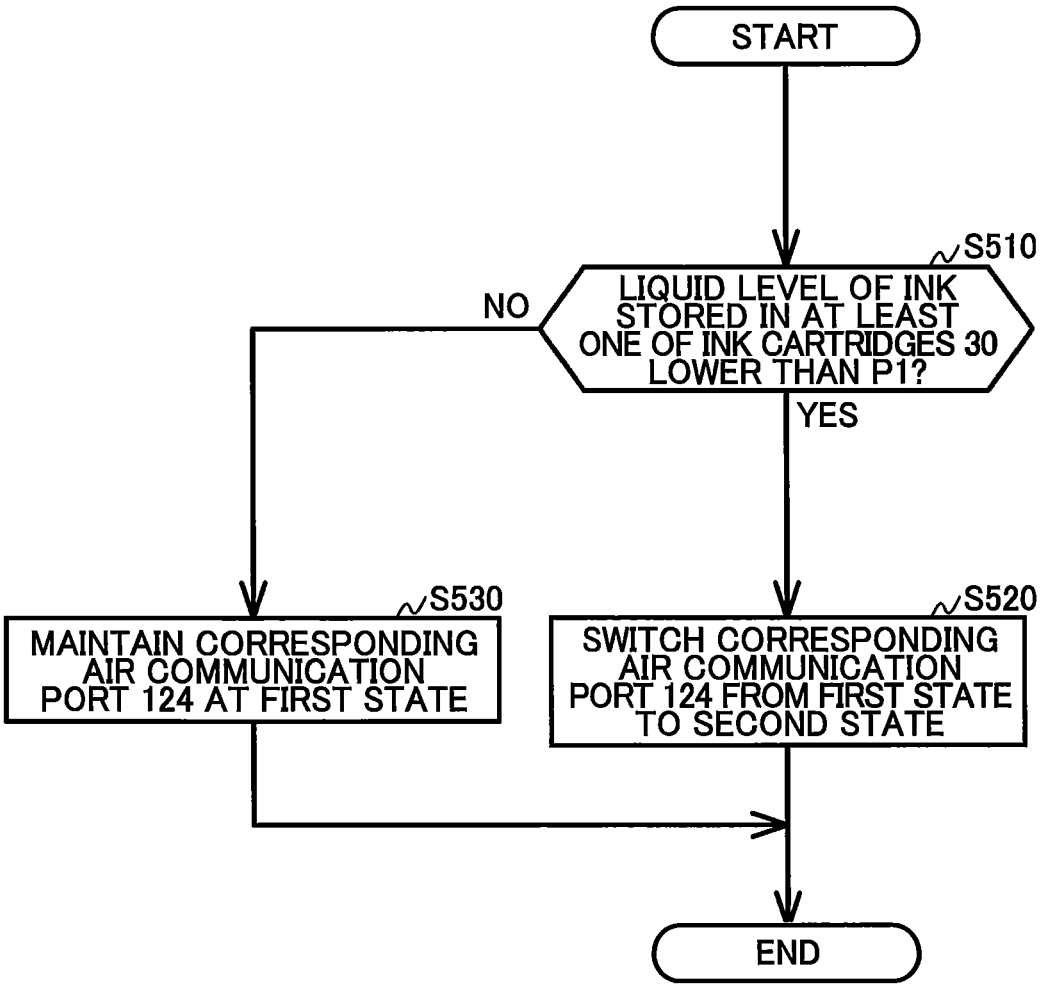
FIG. 12 is a flowchart illustrating steps in a process executed by the controller for switching air communication status in a state where the ink cartridges storing ink of colors of magenta, cyan and yellow are attached to the cartridge-attachment portion according to the embodiment.

With respect to the color ink cartridges 30 storing ink of cyan, magenta and yellow, the controller 130 is configured to perform a process illustrated in FIG. 12, instead of the process of the flowchart of FIG. 9 that is executed for the black ink cartridge 30. The processes of FIGS. 10 and 11 are also configured to be performed in the same way for the color ink cartridges 30. In other words, for the color ink cartridges 30, the process of FIG. 12 and the processes of FIGS. 10 and 11 are configured to be executed. Hereinafter, in order to avoid duplicating explanation, the process of FIG. 12, which is different from the process of FIG. 9 executed for the black ink cartridge 30, will be described.

Referring to FIG. 12, the controller 130 first determines in S510 whether the liquid level of ink is equal to or lower than the position P1 with respect to any one or any two of the three color ink cartridges 30, i.e., at least one of the color ink cartridges 30.

In case that the liquid level of ink stored in any one or any two of the three color ink cartridges 30 is determined to be higher than the position P1 (S510:NO), the controller 130 maintains the air communication port 124 corresponding to the color ink cartridges 30 at the first state in S530.

However, in case that the liquid level of ink stored in at least one (any one or any two) of the three color ink cartridges 30 is determined to be equal to or lower than the position P1 (S510:YES), the controller 130 switches the air communication port 124 from the first state to the second state in S520. With this configuration, evaporation of the ink stored in the storage chambers 121 corresponding to the respective color ink cartridges 30 can be suppressed.

Even if the air communication port 124 provided common to the three color ink cartridges 30 is switched to the second state, the respective three storage chambers 121 are still allowed to communicate with the ambient air at least through the air communication ports 96 of the respective color ink cartridges 30. Further, each of the three storage chambers 121 of the color ink cartridges 30 is also allowed to communicate with the ambient air via the air communication port 96 of the at least one empty ink cartridge 30, through the corresponding storage chamber 121 that is in communication with the remaining storage chambers 121 that is in communication with the air flow path (not shown) via the respective through-holes 119. That is, even if the air communication port 124 is switched to the second state in a state where the liquid level(s) of the ink in one or two of the color ink cartridges 30 still remain(s) higher than the position P1, each of the storage chambers 121 can communicate with the atmosphere. Accordingly, air flow between the inside and outside of each storage chamber 121 can be maintained, thereby reliably supplying ink stored in each storage chamber 121 to the recording portion 24.

Alternatively, the controller 130 may determine whether or not the liquid levels of the ink stored in all of the color ink cartridges 30 are equal to or lower than the position P1.

Figure 13:
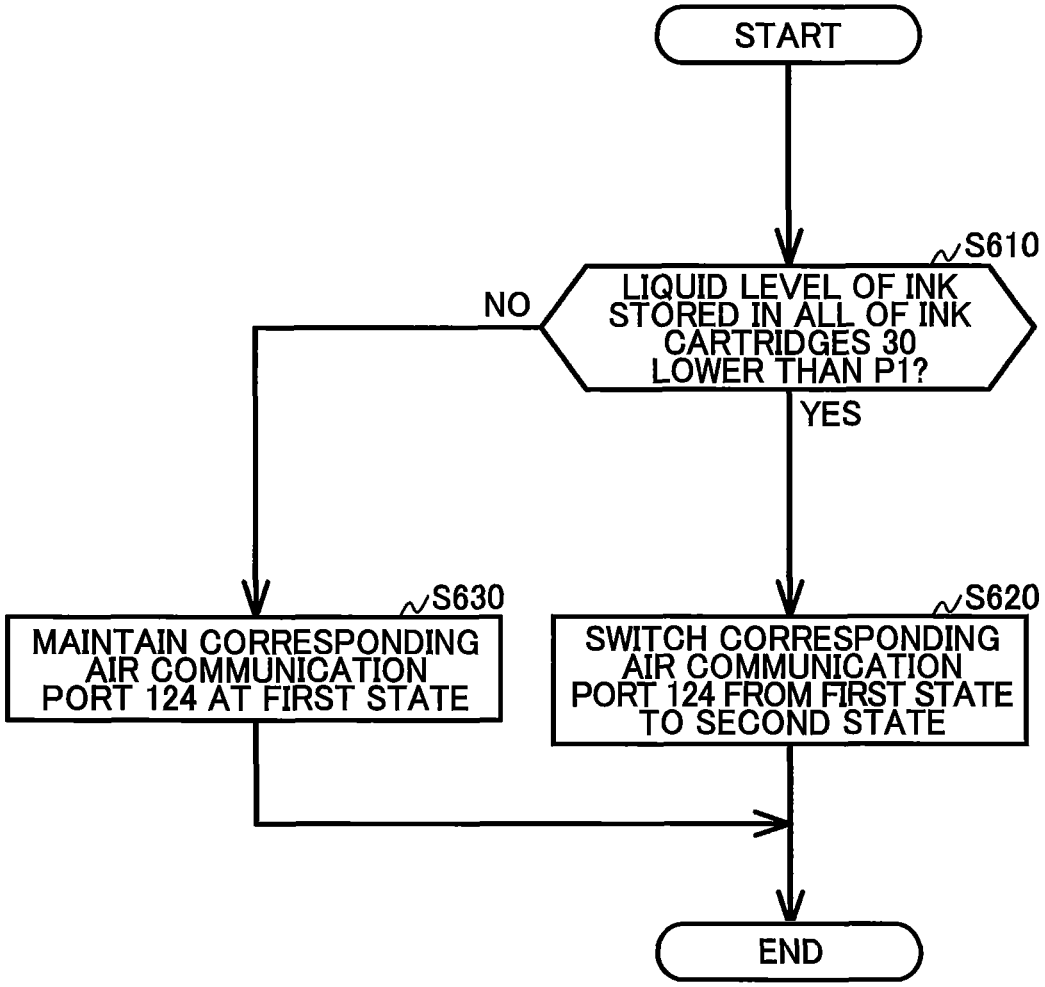
FIG. 13 is a flowchart illustrating steps in a process executed by the controller for switching air communication status in a state where the ink cartridges storing ink of colors of magenta, cyan and yellow are attached to the cartridge-attachment portion according to a variation of the embodiment.

Specifically, referring to FIG. 13, the controller 130 determines in S610 whether or not the liquid levels of the ink stored in all of the three color ink cartridges 30 are equal to or lower than the position P1 in the up-down direction 7.

In case that the liquid level of ink stored in any one or any two of the three color ink cartridges 30 is determined to be still higher than the position P1 (S610:NO), the controller 130 maintains the air communication port 124 corresponding to the color ink cartridges 30 at the first state in S630.

In case that the liquid levels of the ink stored in all of the three color cartridges 30 are determined to be equal to or lower than the position P1 (S610:YES), the controller 130 switches the air communication port 124 from the first state to the second state in S620.

With this configuration, the air communication port 124 is not configured to be switched to the second state (maintained at the first state), unless all of the liquid levels of the ink stored in the storage chambers 32 and 33 of the color ink cartridges 30 fall below the position P1. That is, with respect to the color ink cartridges 30, each of the storage chambers 121, which is provided in the cartridge-attachment portion 110, is made in communication with the air communication port 124 that is also provided in the cartridge-attachment portion 110. This structure can stabilize the liquid level of the ink stored in each storage chamber 121 more reliably than if each of the storage chambers 121 communicates with the ambient air through the air communication port 96 of each color ink cartridge 30 that is not provided in the cartridge-attachment portion 110.

[Operational and Technical Advantages of the Embodiment]

In a state where the ink cartridge 30 is attached to the cartridge-attachment portion 110, the corresponding storage chamber 121 is made in communication with the atmosphere through the corresponding connecting portion 107, ink supply portion 34, storage chamber 32, storage chamber 33, air valve chamber 36 and air communication port 96. In case that the air communication port 124 is at the first state in the state where the ink cartridge 30 is attached to the cartridge-attachment portion 110, the storage chamber 121 is in communication with the ambient air through both of the corresponding air communication port 124 and air communication port 96. That is, the ink stored in the storage chamber 121 may be vaporized through both of the air communication port 96 and the air communication port 124.

In the present embodiment, for both of the black ink cartridge 30 and the color ink cartridges 30, the air communication port 124 is configured to be switched to the second state when the liquid level of the ink stored in the storage chambers 32, 33 of the attached ink cartridge 30 is equal to or lower than the position P1 (S10:YES and S20 in FIG. 9 for the black ink cartridge 30; and S510:YES and S520 in FIG. 12, or S610:YES and S620 in FIG. 13 for color ink cartridges 30). Thus, since air flow at the air communication port 124 is interrupted, this structure of the embodiment can restrain evaporation of the ink stored in the storage chamber 121.

Even if the air communication port 124 is switched to the second state, the storage chamber 121 is still in communication with the atmosphere through the air communication port 96 of the attached ink cartridge 30. This means that the switching of the air communication port 124 to the second state from the first state does not drastically reduce an amount of air flow between the inside and outside of the storage chamber 121. The ink stored in the storage chamber 121 can be supplied to the recording portion 24 appropriately.

Further, in the present embodiment, since the ink supply portion 34 is in communication with the lower end portion of the storage chamber 33, the ink stored in the storage chambers 32 and 33 can be used up reliably.

In a state where the attachment sensor 113 detects that the ink cartridge 30 is not attached to the cartridge-attachment portion 110, the ink supply portion 34 and the connecting portion 107 are not connected to each other. Thus, at this time, the valve 114 of the connecting portion 107 closes off the opening 116. The storage chamber 121 does not communicate with the atmosphere through the air communication port 96. That is, in the state where the air communication port 124 is maintained at the second state and the attachment sensor 113 detects that the ink cartridge 30 is not attached to the cartridge-attachment portion 110, air flow between the inside and outside of the storage chamber 121 is interrupted. In this state, the ink stored in the storage chamber 121 may not be readily supplied to the recording portion 24 and the ink may not be ejected through the nozzles 29 during image-recording operations.

In the present embodiment, however, in a state that the air communication port 124 is at the second state and the attachment sensor 113 detects that the ink cartridge 30 is not attached to the cartridge-attachment portion 110, the air communication port 124 is configured to be switched to the first state upon receipt of an image-recording command (S240:YES and S260 in FIG. 10). With this configuration, since the storage chamber 121 can communicate with the atmosphere through the air communication port 124, the ink in the storage chamber 121 can be readily supplied to the recording portion 24, as long as image-recording operations are executed. The ink can be ejected through the nozzles 29 during the image-recording operations.

In case that: the ink cartridge 30 is detached from the cartridge-attachment portion 110 after the liquid level of the ink in the ink cartridge 30 is determined to be lower than the position P1; and a new ink cartridge 30 is subsequently attached to the cartridge-attachment portion 110 (S410:YES in FIG. 11), ink stored in the new ink cartridge 30 is supplied to the storage chamber 121 and the controller 130 determines in S430 that the liquid level of the ink stored in the storage chambers 32, 33 is neither equal to nor lower than the position P1 (S430:NO). If the air communication port 124 is in the second state under such circumstances, an amount of air flow at the storage chamber 121 may be smaller than if the air communication port 124 is in the second state.

In the embodiment, the air communication port 124 is configured to be switched to the first state from the second state (S450 of FIG. 11) when the liquid level of ink in the storage chamber 121 becomes higher than the position P1. This configuration of the embodiment can thus maintain a suitable amount of air flow between the inside and outside of the storage chamber 121.

Further, in the present embodiment, since the pivoting member 50 is not arranged within the storage chambers 32 and 33 of the ink cartridge 30, the structure of the ink cartridge 30 can be simplified, and an increased amount of ink can be stored in the storage chambers 32 and 33 of the ink cartridge 30 than otherwise.

Modifications and Variations

Various modifications are conceivable.

In the depicted embodiment, the controller 130 is configured to determine that the liquid level of the ink stored in the storage chamber 121 of each tank 103 and the liquid level of the ink stored in the storage chambers 32 and 33 of each ink cartridge 30 are lower than or equal to the position P1 in the up-down direction 7 based on the change in signal outputted from the corresponding liquid-level sensor 55 from low level to high level attributed to the change in the posture of the pivoting member 50.

However, the controller 130 may be configured to determine that the liquid level of the ink stored in the storage chamber 121 of each tank 103 and the liquid level of the ink stored in the storage chambers 32 and 33 of each ink cartridge 30 are lower than or equal to the position P1 in the up-down direction 7 based on a condition other than that of the embodiment.

For example, the controller 130 may be configured to count the number of dots of ink droplets ejected from the recording head 21 after the signal outputted from the liquid-level sensor 55 to the controller 130 switches from the low level signal to the high level signal due to the change in posture of the pivoting member 50. In this case, the controller 130 may be configured to determine that the liquid level of the ink stored in the storage chamber 121 of each tank 103 and the liquid level of the ink stored in the storage chambers 32 and 33 of each ink cartridge 30 are at a predetermined position lower than the position P1 in the up-down direction 7 when the counted value of the dot is greater than or equal to a predetermined value. Incidentally, the predetermined value may be set on a basis of an internal volume of a portion of the storage chamber 121 positioned below the connecting portion 107, for example.

Further, in the depicted embodiment, the second state of the air communication port 124 denotes a state where air flow from the air communication port 124 to the outside of the cartridge-attachment portion 110 is shut off. However, in the second state, air flow may not be completely blocked at the air communication port 124, provided that an amount of air that circulates through the air communication port 124 per unit of time is smaller at the second state than at the first state.

In order to reduce the amount of air that circulates through the air communication port 124 per unit of time at the second state than that at the first state, the inner peripheral surface of the hollow cylinder of the switching portion 56 may be formed with a plurality of air ports with different sizes (a first port and a second port smaller than the first port), for example. In this case, the air communication port 124 becomes the first state when the connection port comes to a position opposing the first port in accordance with rotation of the rotary body. On the other hand, the air communication port 124 becomes the second state when the connection port comes to a position opposing the second port in accordance with rotation of the rotary body. Alternatively, the first port and the second port may be formed to have the same size as each other, but a semipermeable membrane may be provided only at the second port, for example.

Further, in the above-described embodiment, the attachment sensor 113 and the liquid-level sensor 55 are optical sensors each having the light-emitting portion and the light-receiving portion. However, the attachment sensor 113 and the liquid-level sensor 55 may be sensors of a different type from the optical sensor, such as a proximity sensor.

In the above-described embodiment, the liquid level of the ink stored in the storage chamber 121 of the tank 103 becoming lower than the position P1 is detected based on the pivotal movement of the pivoting member 50 disposed in the storage chamber 121 of each tank 103. However, the detection may be made by any method other than the pivotal movement of the pivoting member 50.

For example, a prism may be disposed in the storage chamber 121 of each tank 103 at the same height as the position P1. Whether the liquid level of the ink stored in the storage chamber 121 of the tank 103 is lower than or equal to the position P1 may be determined on a basis of a travelling direction of light incident on the prism that may vary depending on whether or not the liquid level is higher than the prism.

Alternatively, for example, two electrodes may be disposed in the storage chamber 121 of each tank 103. One of the two electrodes may have a lower end at a position slightly higher than the position P1, while the other of the two electrodes may have a lower end at a position below the position P1. Whether the liquid level of the ink stored in the storage chamber 121 of the tank 103 is lower than or equal to the position P1 may be determined depending on whether or not current flows between the two electrodes through the ink.

In the depicted embodiment, the through-hole 119 is sealed by the semipermeable membrane 118. However, the through-hole 119 may not be sealed with the semipermeable membrane 118. Likewise, while the through-hole 94 is sealed by the semipermeable membrane 80 in the embodiment, the through-hole 94 may not be sealed by the semipermeable membrane 80.

In the above-described embodiment, the connecting portion 107 of the cartridge-attachment portion 110 and the ink supply portion 34 of the ink cartridge 30 both extend in the horizontal direction. Further, the ink cartridge 30 is configured to be attached to the cartridge-attachment portion 110 by being inserted into the cartridge-attachment portion 110 in the horizontal direction. At this time, the connecting portion 107 and the ink supply portion 34 are connected to each other in the horizontal direction. However, the ink cartridge 30 may be attached to the cartridge-attachment portion 110 by being inserted into the cartridge-attachment portion 110 in a direction other than the horizontal direction, for example, in the up-down direction 7.

In this case, for example, the connecting portion 107 may protrude upward from the case 101 while the ink supply portion 34 may protrude downward from the bottom wall of the ink cartridge 30. Incidentally, in this case, the position P1 may be set, for example, at a center position of the connecting portion 107 in the up-down direction 7 or a center position of the ink supply portion 34 in the up-down direction 7.

In the above-described embodiment, ink serves as an example of liquid. However, for example, in place of ink, a pretreatment liquid that is ejected onto the recording paper prior to the ink during an image recording operation may be stored in the ink cartridge 30 and the tank 103. Alternatively, water that is used for cleaning the recording head 21 may be stored in the ink cartridge 30 and the tank 103.

While the description has been made in detail with reference to the embodiments thereof, it would be apparent to those skilled in the art that many modifications and variations may be made therein without departing from the scope of the disclosure.

REMARKS

The multifunction peripheral 10 is an example of an image-recording apparatus. The cartridge-attachment portion 110 is an example of a cartridge-attachment portion. The ink cartridge 30 is an example of a cartridge. The color ink cartridges 30 are examples of a liquid cartridge. The storage chamber 32 and the storage chamber 33 are an example of a first storage chamber. The air communication port 96 is an example of a first air communication portion. The ink supply portion 34 is an example of a supply portion. The connecting portion 107 is an example of a connecting portion. The storage chamber 121 is an example of a second storage chamber. The air communication port 124 is an example of a second air communication portion. The communication port 129 is an example of a liquid inlet port. The communication port 128 is an example of a liquid outlet port. The internal space 117 of the connecting portion 107 is an example of a liquid passage. The valve 114 is an example of a valve. The switching portion 56 is an example of a switching portion. The recording portion 24 is an example of a recording portion. The controller 130 is an example of a controller. The attachment sensor 113 is an example of a first detector. The liquid-level sensor 55 is an example of a second detector. The detected portion 54 of the pivoting member 50 is an example of a detected portion.

What is claimed is:

1. An image-recording apparatus comprising:

a cartridge comprising:

a first storage chamber configured to store liquid;

a first air communication portion configured to allow the first storage chamber to communicate with an atmosphere; and a supply portion configured to supply the liquid stored in the first storage chamber;

a cartridge-attachment portion comprising:

a connecting portion configured to be connected to the supply portion;

a liquid inlet port in communication with the connecting portion;

a second storage chamber in communication with the connecting portion through the liquid inlet port and configured to store the liquid supplied from the connecting portion connected to the supply portion through the liquid inlet port;

a liquid outlet port positioned lower than the liquid inlet port in a vertical direction and configured to discharge the liquid from the second storage chamber; and a second air communication portion configured to allow the second storage chamber to communicate with the atmosphere;

a switching portion configured to switch a state of the second air communication portion between a first state and a second state, air being allowed to flow through the second air communication portion in the first state, and an amount of air that flows through the second air communication portion per unit of time being smaller in the second state than in the first state;

a recording portion comprising a nozzle through which the liquid supplied from the second storage chamber through the liquid outlet port is configured to be ejected; and a controller configured to determine a liquid level of the liquid stored in the first storage chamber in the vertical direction, the controller being further configured to control the switching portion to switch the second air communication portion to the second state from the first state in case that the liquid level of the liquid stored in the first storage chamber is determined to be equal to or lower than a position of the liquid inlet port in the vertical direction.

2. The image-recording apparatus according to claim 1, wherein the supply portion is in communication with a lower end of the first storage chamber.

3. The image-recording apparatus according to claim 1, wherein the connecting portion has a liquid passage and comprises a valve configured to open and close the liquid passage, the valve opening the liquid passage in a state where the connecting portion is connected to the supply portion, and the valve closing the liquid passage in a state where the connecting portion is disconnected from the supply portion;

wherein the supply portion and the connecting portion are connected to each other in a state where the cartridge is attached to the cartridge-attachment portion, and the supply portion and the connecting portion are disconnected from each other in a state where the cartridge is detached from the cartridge-attachment portion;

the image-recording apparatus further comprising a first detector configured to detect whether or not the cartridge is attached to the cartridge-attachment portion;

wherein the controller is configured to control the recording portion to perform image recordation on a sheet, the controller controlling the switching portion to switch the second communication portion to the first state from the second state in case that:

the first detector detects that the cartridge is not attached to the cartridge-attachment portion;

the second air communication portion is at the second state; and the controller received an image-recording command to perform the image recordation on the sheet.

4. The image-recording apparatus according to claim 1, wherein the cartridge comprises a plurality of liquid cartridges;

wherein, in the cartridge-attachment portion, the connecting portion, the liquid inlet port, and the second storage chamber are provided in one-to-one correspondence with each of the plurality of liquid cartridges, the second air communication portion being provided in communication with each of the plurality of second storage chambers;

wherein the controller is configured to determine the liquid level of the liquid stored in the first storage chamber of each of the plurality of liquid cartridges; and wherein the controller is configured to control the switching portion to switch the second air communication portion to the second state from the first state in case that the liquid level of the liquid stored in each of the first storage chambers is determined to be equal to or lower than the position of the corresponding the liquid inlet port in the vertical direction.

5. The image-recording apparatus according to claim 1, wherein the cartridge comprises a plurality of liquid cartridges;

wherein, in the cartridge-attachment portion, the connecting portion, the liquid inlet port, and the second storage chamber are provided in one-to-one correspondence with each of the plurality of liquid cartridges, and the second air communication portion being provided in communication with each of the plurality of second storage chambers;

wherein the controller is configured to determine the liquid level of the liquid stored in the first storage chamber of each of the plurality of liquid cartridges; and wherein the controller is configured to control the switching portion to switch the second air communication portion to the second state from the first state in case that the liquid level of the liquid stored in at least one of the plurality of first storage chambers is determined to be equal to or lower than the position of the corresponding the liquid inlet port in the vertical direction.

6. The image-recording apparatus according to claim 1, further comprising a first detector configured to detect whether or not the cartridge is attached to the cartridge-attachment portion, wherein the supply portion and the connecting portion are connected to each other in a state where the cartridge is attached to the cartridge-attachment portion, and the supply portion and the connecting portion are disconnected from each other in a state where the cartridge is detached from the cartridge-attachment portion;

wherein the controller is configured to control the switching portion to switch the second air communication portion to the first state from the second state, in case that following conditions A, B and C are met, where:

the condition A is met when the first detector detects that the cartridge whose liquid level of liquid stored in the first storage chamber is determined to be equal to or lower than the position of the liquid inlet port in the vertical direction is detached from the cartridge-attachment portion;

the condition B is met when the first detector detects that another cartridge is attached to the cartridge-attachment portion after the condition A is met; and the condition C is met when the controller determines that the liquid level of liquid stored in the first storage chamber of the another cartridge attached to the cartridge-attachment portion is higher than the position of the liquid inlet port in the vertical direction after the condition B is met.

7. The image-recording apparatus according to claim 1, further comprising:

a detected portion positioned in the second storage chamber, the detected portion being configured to change a state thereof depending on whether or not the liquid level of the liquid in the second storage chamber is positioned equal to or lower than a position of the liquid inlet port in the vertical direction; and a second detector configured to detect the change in the state of the detected portion, wherein the controller is configured to determine the liquid level of the liquid stored in the first storage chamber on a basis of signals transmitted from the second detector, the signals being indicative of the change in the state of the detected portion.

8. The image-recording apparatus according to claim 1, wherein, in the second state, air flow through the second air communication portion is interrupted.

* * * * *